US008120264B2

(12) United States Patent
Muramatsu et al.

(10) Patent No.: US 8,120,264 B2
(45) Date of Patent: Feb. 21, 2012

(54) DISCHARGE LAMP LIGHTING CIRCUIT

(75) Inventors: Takao Muramatsu, Shizuoka (JP); Tomoyuki Ichikawa, Shizuoka (JP); Shinji Ohta, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 415 days.

(21) Appl. No.: 12/398,279

(22) Filed: Mar. 5, 2009

(65) Prior Publication Data

US 2009/0224682 A1 Sep. 10, 2009

(30) Foreign Application Priority Data

Mar. 5, 2008 (JP) ..... 2008-054970
Nov. 25, 2008 (JP) ..... 2008-299638

(51) Int. Cl.
*H05B 37/00* (2006.01)

(52) U.S. Cl. ..... 315/224; 315/209 R; 315/291; 315/307

(58) Field of Classification Search ..... 315/200 R, 315/209 R, 291, 326, 224, 307
See application file for complete search history.

(56) References Cited

U.S. PATENT DOCUMENTS

| | | | | |
|---|---|---|---|---|
| 5,212,428 | A | 5/1993 | Sasaki et al. | |
| 5,349,268 | A | 9/1994 | Nagai et al. | |
| 5,463,281 | A * | 10/1995 | Linssen | 315/209 R |
| 6,057,650 | A | 5/2000 | Betz et al. | |
| 7,141,937 | B2 * | 11/2006 | Kumagai et al. | 315/224 |
| 2004/0113567 | A1 * | 6/2004 | Yamauchi et al. | 315/291 |
| 2005/0264237 | A1 * | 12/2005 | Ishizuka | 315/209 R |
| 2006/0208664 | A1 * | 9/2006 | Okishima | 315/291 |
| 2007/0164687 | A1 * | 7/2007 | Watanabe et al. | 315/291 |

FOREIGN PATENT DOCUMENTS

| | | |
|---|---|---|
| GB | 498107 | 1/1939 |
| JP | 04-141988 | 5/1991 |
| JP | 06-124790 | 6/1994 |
| JP | 11-329777 | 11/1999 |

OTHER PUBLICATIONS

Office action in Korean Patent Application No. 10-2009-0018511 (Jul. 21, 2010).

* cited by examiner

*Primary Examiner* — David Hung Vu
(74) *Attorney, Agent, or Firm* — Fish & Richardson P.C.

(57) ABSTRACT

A discharge lamp lighting circuit for supplying an AC power to a discharge lamp includes first and second converters for receiving a DC voltage and stepping up the voltage. A controlling circuit drives the first and second converters CON1, CON2 alternately at a first frequency and stops an operation of a side that is not driven such that the AC power is supplied to the discharge lamp to execute a lighting operation.

10 Claims, 16 Drawing Sheets

COMPARATIVE ART

DISCHARGE LAMP LIGHTING CIRCUIT

RELATED APPLICATION

This application claims the benefit of priorities of Japanese patent applications no. JP2008-054970, filed on Mar. 5, 2008 and no. JP2008-299638, filed on Nov. 25, 2008, the contents of which are incorporated herein by reference.

TECHNICAL FIELD

The present disclosure relates to a discharge lamp lighting circuit for preventing flame failure of a discharge lamp.

BACKGROUND

When a discharge lamp such as a metal halide lamp or the like is turned ON in AC mode, it is desirable that, in order to avoid occurrence of a phenomenon in which the lighting frequency resonates with an air flow in a discharge tube (i.e., the so-called acoustic resonance), the discharge lamp should be lit at a frequency of several hundred Hz or less. For example, in an automobile discharge lamp, a recommended value of lighting frequency of the discharge lamp is 250 Hz to 750 Hz. Nevertheless, the existing discharge lamp lighting circuit for the vehicle has a circuit configuration such that an input DC voltage from a battery is raised to a DC voltage necessary for the discharge lamp by a DC/DC converter, and then this DC voltage is AC-converted into the lighting frequency of the discharge lamp by a full-bridge inverter provided at a later stage. Also, a starter circuit generates high-voltage pulses of about 25 kV required to start the discharge lamp. A lighting auxiliary circuit promotes a discharge growth from a glow discharge to an arc discharge by supplying an excessive current immediately after the discharge lamp is started, so that this lighting auxiliary circuit allows instantaneous lighting.

Japanese Patent Document JP-A-11-329777 discloses a discharge lamp lighting circuit for the vehicle equipped with the DC/DC converter and the full-bridge inverter.

However, the conventional discharge lamp lighting circuit has a standardized configuration and contains a large number of large-size electronic components, which prevents a size reduction and a cost reduction of the discharge lamp lighting circuit and also becomes a major cause for the fact that the automobile discharge lamp cannot become sufficiently available.

For example, in the circuit configuration disclosed in JP-A-11-329777, there is a large amount of heat produced by the switching element and the rectifier diode in the DC/DC converter, and the temperature of respective elements tends to rise locally. In addition, according to the same configuration, a driver circuit for driving four switching elements of the full-bridge inverter is needed, which also limits size reduction and cost reduction of the discharge lamp lighting circuit.

SUMMARY

The present invention, in some implementations, achieves a size reduction and a cost reduction of a lighting circuit by changing fundamentally the above-mentioned standardized configuration.

According to a first aspect of the present invention, a discharge lamp lighting circuit for supplying an AC power to a discharge lamp includes first and second converters for receiving a DC voltage and stepping up the voltage. A controlling circuit for driving the first and second converters alternately at a first frequency and stopping an operation of a side that is not driven to apply a control such that the AC power is supplied to the discharge lamp to execute a lighting operation.

Therefore, the circuit itself can be reduced in size by employing the first and second converters.

In some implementations, the first and second converters are implemented by any one of (a) a converter having an insulated-type first transformer, a first switching element connected in series between a DC power supply and a primary winding of the first transformer, and a second switching element connected in series between an output end and a secondary winding of the first transformer, whereby the first and second switching elements are driven in synchronism with each other in each half period of the first frequency at a second frequency higher than the first frequency, (b) a converter having an insulated-type second transformer, a third switching element connected in series between the DC power supply and a primary winding of the second transformer, a first rectifying element connected in series between one output end and a secondary winding of the second transformer, and a fourth switching element connected between one output end and the other output end, whereby the fourth switching element is put in an OFF state while the third switching element executes a driving operation and also the fourth switching element is put in an ON state while the third switching element executes a stopping operation, or (c) a converter having an insulated-type third transformer, a fifth switching element connected in series between a DC power supply and a primary winding of the third transformer, a sixth switching element connected in series between an output end and a secondary winding of the third transformer, and a second rectifying element connected in parallel with the sixth switching element, whereby the sixth switching element is put in an OFF state while the fifth switching element executes a driving operation and also the sixth switching element is put in an ON state while the fifth switching element executes a stopping operation.

Also, any one of the second, fourth, and sixth switching elements on secondary sides of the first and second converters can be implemented by an insulated gate bipolar transistor.

The insulated-type first to third transformers in the first and second converters can be implemented such that a part of magnetic members is shared mutually.

According to some implementations, the discharge lamp lighting circuit includes a starter circuit for starting the discharge lamp, and having a starter capacitor that receives a charging voltage from one of the first and second converters. The converter on a side from which the charging voltage is supplied to the starter circuit is implemented the converter set forth in (b) or (c), and the fourth or sixth switching element on the secondary side is implemented by the insulated gate bipolar transistor.

In the discharge lamp lighting circuit in one mode, each of the first and second converters includes an insulated second transformer, a third switching element connected in series with a primary winding of the second transformer, a first rectifying element provided between an output end and a secondary winding of the second transformer, and a fourth switching element and a current detecting resistor connected in series between the output end and a fixed voltage terminal. Also, the controlling circuit puts the fourth switching element in an OFF state while the third switching element is caused to drive/operate, and puts the fourth switching element in an ON state while the third switching element is caused to stop an operation. The controlling circuit adjusts an ON/OFF duty ratio of the third switching element on the first converter side based, at least in part, on a voltage drop produced in the current detecting resistor on the second converter side while the first converter is caused to drive/operate, and adjusts an ON/OFF duty ratio of the third switching element on the second converter side based, at least in part, on a voltage drop produced in the current detecting resistor on the first converter side while the second converter is caused to drive/operate.

According to this mode, the lamp current flowing through the discharge lamp in the first direction and the lamp current flowing through the discharge lamp in the second direction opposite to the first direction can be detected, for example, by using the current detecting resistors provided to the first and second converters, respectively, and the third switching elements provided to the first and second converter respectively can be driven. Also, the charges stored in the smoothing capacitors provided to the output ends of the first and second converters cannot flow in the discharge lamp in the open state of the discharge lamp. Therefore, such charges tend to flow in the fixed voltage terminal (e.g., the ground terminal) via the fourth switching element. At this time, the current flowing through the fourth switching element can be restricted by the current detecting resistor, and thus the circuit can be protected.

In the discharge lamp lighting circuit in another mode, each of the first and second converters includes an insulated second transformer, a third switching element connected in series with a primary winding of the second transformer, a first rectifying element provided between an output end and a secondary winding of the second transformer, and a fourth switching element whose one end is connected to the output end. Another end of the fourth switching element on the first converter side and other end of the fourth switching element provided on the second converter side are connected in common. The discharge lamp lighting circuit further includes a current detecting resistor provided between the other end of the fourth switching element connected in common and a fixed voltage terminal. The controlling circuit puts the fourth switching element in an OFF state while the third switching element is caused to drive/operate, and puts the fourth switching element in an ON state while the third switching element is caused to stop an operation, and the controlling circuit adjusts an ON/OFF duty ratio of the third switching element on the first converter side based, at least in part, on a voltage drop produced in the current detecting resistor on the second converter side while the first converter is caused to drive/operate, and adjusts an ON/OFF duty ratio of the third switching element on the second converter side based, at least in part, on a voltage drop produced in the current detecting resistor on the first converter side while the second converter is caused to drive/operate.

According to yet another mode, the lamp current flowing through the discharge lamp in the first direction and the lamp current flowing through the discharge lamp in the second direction opposite to the first direction can be detected, for example, by using the current detecting resistor provided in common to the first and second converters respectively. The charges stored in the smoothing capacitors provided to the output ends of the first and second converters cannot flow in the discharge lamp in the open state of the discharge lamp. Therefore, such charges tend to flow in the fixed voltage terminal (e.g., the ground terminal) via the fourth switching element. At that time, the current flowing through the fourth switching element can be restricted by the current detecting resistor, and thus the circuit can be protected. This mode is advantageous from the perspective of circuit area and a cost.

In some implementations, the discharge lamp lighting circuit results in a size reduction and a cost reduction. Also, since the first and second converters are alternately operated, the amount of produced heat can be reduced, and locations where the heat is produced can be scattered so that the local temperature rise can be reduced or eliminated, and reliability of the circuit can be improved.

According to some implementations, a reduction in the number of components, and a size reduction and a cost reduction of the circuit can be attained.

According to some implementations, since a part of the magnetic material of the first and second transformers is shared with each other, an installing volume can be reduced and a size reduction can be attained.

According to some implementations, heat generation of the circuit can be reduced.

According to some implementations, the IGBT is employed as the switching element of the converter on the side where a charging voltage is supplied to the starter circuit, which is effective in reducing the heat generation of the circuit.

As described in greater detail below, the discharge lamp lighting circuit can be used as part of car lighting equipment, such as a head lamp, for example. Also, the electronic components are made compatible by combining the DC/DC converting function in the DC/DC converter with the DC/AC converting function in the full-bridge inverter and thus a size reduction and a cost reduction of the circuit can be attained.

Other features and advantages will be readily apparent from the detailed description and the accompanying drawings and from the claims.

DETAILED DESCRIPTION

First Embodiment

Figure 1:
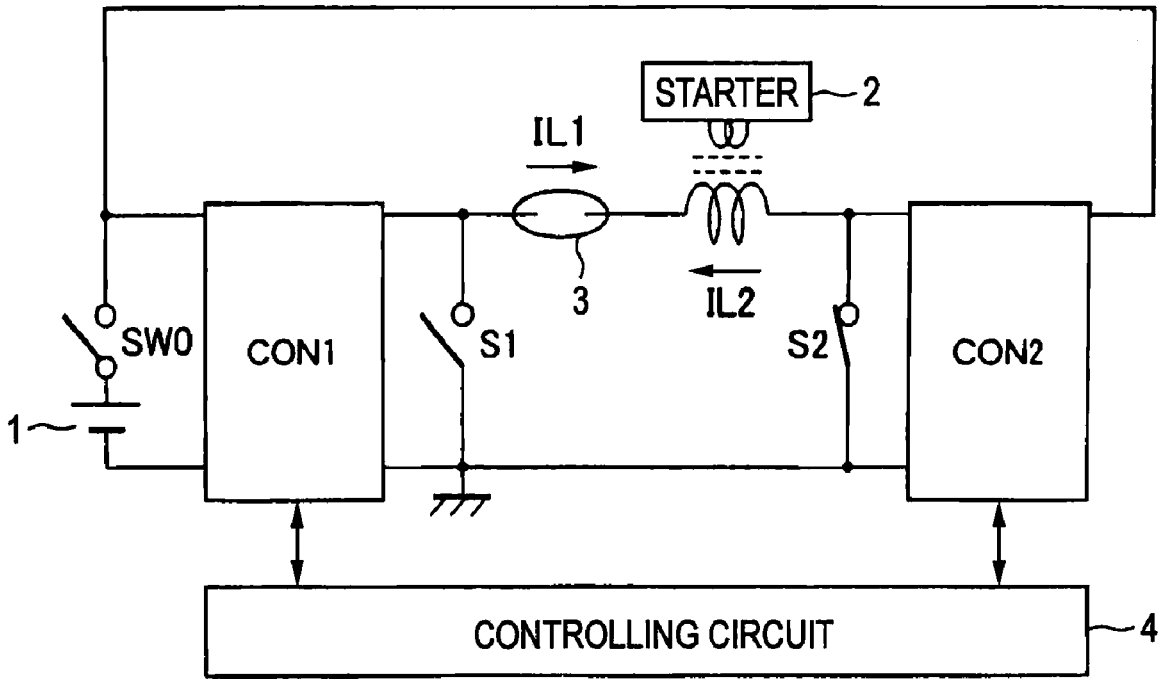
[FIG. 1] A conceptual view of a discharge lamp lighting circuit according to a first embodiment of the present invention.

A configuration of a discharge lamp lighting circuit according to a first embodiment of the present invention is shown in FIG. 1, and is explained below.

As shown in FIG. 1, the discharge lamp lighting circuit can be part of car lighting equipment, such as a head lamp, for example. A low-frequency AC lighting system is employed, and a power supply 1 such as a battery, a switch SW0, two systems of first and second converters CON1, CON2, switching elements S1, S2, a starter circuit 2, and a discharge lamp 3 are provided. The first and second converters CON1, CON2 are a step-up/down converter that not only steps up a voltage but also steps down a voltage respectively, and output terminals as the converter outputs are connected electrically to electrodes of the discharge lamp 3 respectively.

In such configuration, when the discharge lamp 3 is lit by turning ON the switch SW0, a controlling circuit 4 causes the first and second converters CON1, CON2 to operate alternately. Then, the controlling circuit 4 connects the output of the converter CON1 or CON2 whose operation is stopped to the ground GND via the switching element S1 or S2. AC power is supplied to the discharge lamp 3 by repeating such operations. A frequency at which the first and second converters CON1, CON2 are operated alternately is defined as a "lighting frequency".

Operation of the discharge lamp lighting circuit is now explained.

For example, when a current IL1 (whose flowing direction is indicated by an arrow along with the same symbol) flows through the discharge lamp 3, respective operation and states are set under control of the controlling circuit 4 such that the first converter CON1 has a voltage step-up operation, the second converter CON2 is set in a stopped state, the switching element S1 is set in an open state, and the switching element S2 is set in a short state (GND state).

When the direction of the current flowing through the discharge lamp 3 is switched to a current IL2 (whose flowing direction is indicated by an arrow along with the same symbol) from this state, following controls are made sequentially.

That is, to provide a time in which the operations of both the first converter CON1 and the second converter CON2 are stopped, initially the controlling circuit 4 stops the operation of the first converter CON1. Then, the controlling circuit 4 switches the switching element S2 from a short state to an open state, and switches the switching element S1 from an open state to a short state. Then, the controlling circuit 4 causes the second converter CON2 to start the operation from its stop state. With the above operations, the direction of the current flowing through the discharge lamp 3 is switched from the current IL1 to the current IL2.

In contrast, the direction of the current flowing through the discharge lamp 3 is switched from the current IL2 to the current IL1, controls are made by the controlling circuit 4 in following sequences.

That is, to provide a time in which the operations of both the first converter CON1 and the second converter CON2 are stopped, initially the controlling circuit 4 stops the operation of the second converter CON2. Then, the controlling circuit 4 switches the switching element S1 from a short state to an open state, and switches the switching element S2 from an open state to a short state. Also, the controlling circuit 4 causes the first converter CON1 to start the operation from its stop state. With the foregoing operations, the direction of the current flowing through the discharge lamp 3 is switched from the current IL2 to the current IL1.

In this manner, the discharge lamp lighting circuit according to the first embodiment is the discharge lamp lighting circuit of the low-frequency AC lighting system and has two systems of step-up/down converters. Converter outputs of the first and second converters CON1, CON2 are connected to the electrodes of the discharge lamp 3, respectively. Operation/stop of the first and second converters CON1, CON2 is repeated alternately at the "lighting frequency" of the discharge lamp 3 under control of the controlling circuit 4. Therefore, the low-frequency AC power suitable for this discharge lamp 3 can be supplied.

Next, discharge lamp lighting circuits according to second to seventh embodiments are described.

Second Embodiment

Figure 2:
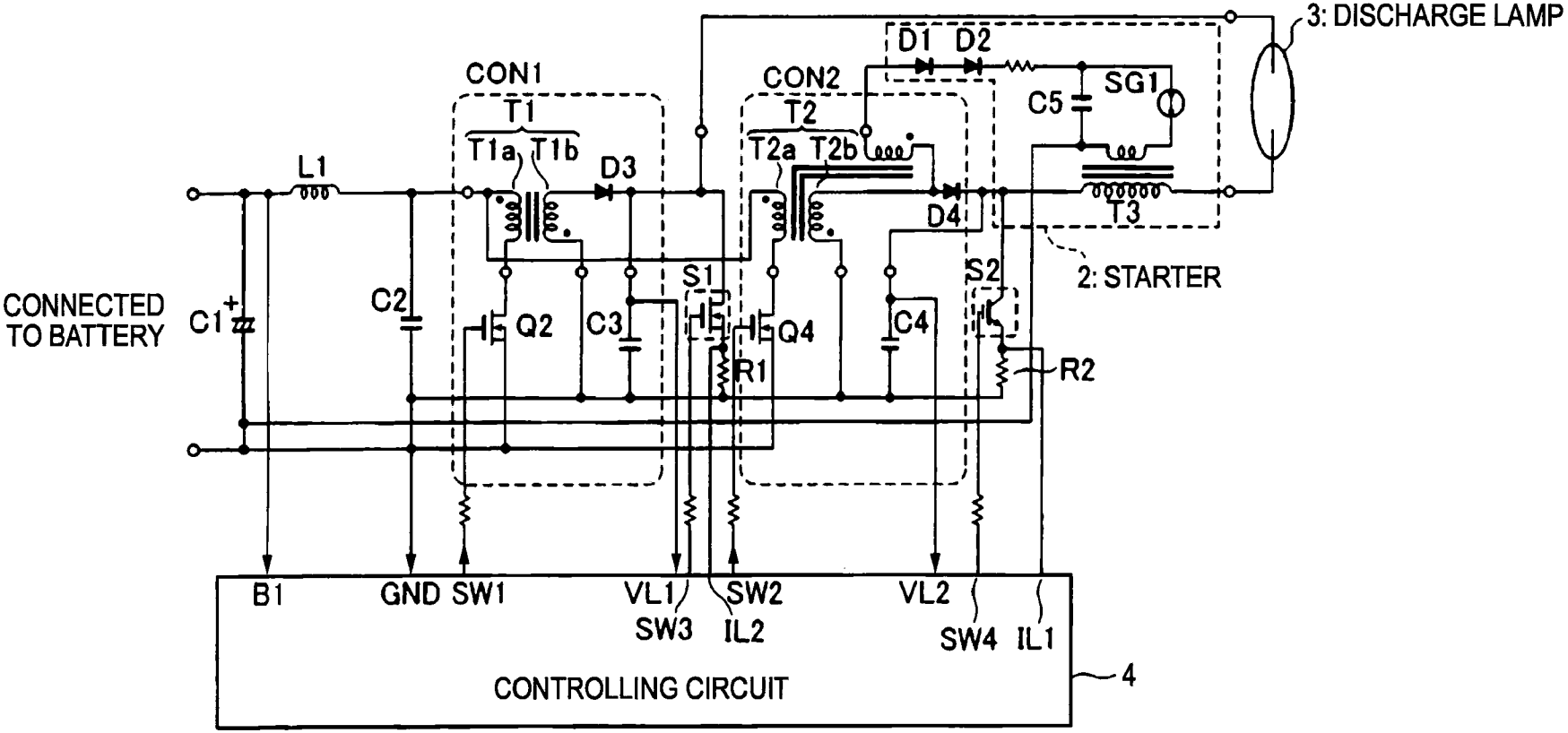
[FIG. 2] A conceptual view of a discharge lamp lighting circuit according to a second embodiment of the present invention.

A configuration of a discharge lamp lighting circuit according to a second embodiment of the present invention is shown in FIG. 2, and is explained below.

As shown in FIG. 2, the discharge lamp lighting circuit includes the first and second converters CON1, CON2, the starter circuit 2, the discharge lamp 3, and the controlling circuit 4.

A power supply voltage supplied from a power supply (not shown) is supplied to the primary side (primary winding T1*a*) of a transformer T1 of the first converter CON1 via an inductor L1. One end of a capacitor C1 is connected to a terminal of the inductor L1 on the power supply side, and the other end is connected to the ground. Winding starting ends of respective windings T1*a*, T1*b* of the transformer T1 are indicated with a black dot in FIG. 2. The first converter CON1 is constructed such that a switching element Q2 is connected to a winding terminating end of the primary winding T1*a* of the transformer T1, a rectifier diode D3 and a smoothing capacitor C3 are arranged to a winding terminating end of the secondary winding T1*b* of the transformer T1, and a terminal voltage of the smoothing capacitor C3 is extracted as an output voltage. In this example, an N-channel MOSFET (field effect transistor) is employed as the switching element Q2, a control signal SW1 from the controlling circuit 4 is supplied to a gate of the N-channel MOSFET, and the switching of the switching element Q2 is controlled. Thus, an output voltage value is controlled variably.

Energy stored in the transformer T1 is accumulated in the smoothing capacitor C3 via the rectifier diode D3 by ON/OFF control of the switching element Q2. The switching element S1 is provided to an output end of the first converter CON1.

In this example, the N-channel MOSFET (field effect transistor) is employed as the switching element S1, and a control signal SW3 is supplied from the controlling circuit 4 to a gate of the N-channel MOSFET, and thus the switching of the switching element S1 is controlled. A drain of the switching element S1 is connected to a cathode of the rectifier diode D3, and a source of the switching element S1 is connected to a ground end GND of the smoothing capacitor C3 via a current detecting resistor R1. A connection point between the resistor R1 and the switching element S1 is connected to the controlling circuit 4, and the current IL1 is detected from this connection point.

The power supply voltage supplied from the power supply (not shown) also is supplied to the primary side (primary winding T2*a*) of a transformer T2 of the second converter CON2 via the inductor L1. Winding starting ends of respective windings T2*a*, T2*b* of the transformer T2 are indicated with a black dot in FIG. 2. The second converter CON2 is constructed such that a switching element Q4 is connected to a winding terminating end of the primary winding T2*a* of the transformer T2, a rectifier diode D4 and a smoothing capacitor C4 are arranged to a winding terminating end of the secondary winding T2*b* of the transformer T2, and a terminal voltage of the smoothing capacitor C4 is extracted as an output voltage. In this example, the N-channel MOSFET (field effect transistor) is employed as the switching element Q4, a control signal SW2 from the controlling circuit 4 is supplied to the gate of the N-channel MOSFET, and the switching of the switching element Q4 is controlled. Thus, the output voltage value is controlled variably.

Energy stored in the transformer T2 is accumulated in the smoothing capacitor C4 via the rectifier diode D4 by ON/OFF control of the switching element Q4. The switching element S2 is provided to an output end of the second converter CON2. In this example, an insulated gate bipolar transistor (IGBT) is employed as the switching element S2, a control signal SW4 is supplied to a gate of the IGBT from the controlling circuit 4, and thus the switching of the switching element S2 is controlled. A collector of the switching element S2 is connected to a cathode of the rectifier diode D4, and an emitter of the switching element S2 is connected to a ground terminal GND of the smoothing capacitor C4 via a current detecting resistor R2. A connection point between the resistor R2 and the switching element S2 is connected to the controlling circuit 4, and the current IL2 is detected from this connection point.

The starter circuit 2 has a transformer T3. A capacitor C5 and a switching element SG1 are provided to a primary winding of the transformer T3 of the primary side circuit that contains the primary winding of the transformer T3. In this example, a spark gap element or the like is employed as the switching element SG1. That is, one end of the capacitor C5 is connected to one ends of the primary winding and a secondary winding of the transformer T3, and the other end of the capacitor C5 is connected to the other end of the primary winding via the switching element SG1. More particularly, when a voltage fed to the switching element SG1 exceeds a threshold value and the switching element SG1 becomes conductive, the charges stored in the capacitor C5 are discharged. As a result, a high-voltage pulse generated in the secondary winding of the transformer T3 is superposed on the output of the first or second converter CON1, CON2, and then fed to the discharge lamp 3 as a starting pulse.

In this example, the high voltage required to produce a charging voltage to the starter circuit can be applied to the switching element S2. Therefore, when the IGBT, which has a high withstand voltage and whose ON voltage is low, is employed as this switching element S2, a power loss caused in the element can be suppressed and heat generation in the circuit can be reduced.

Figure 3:
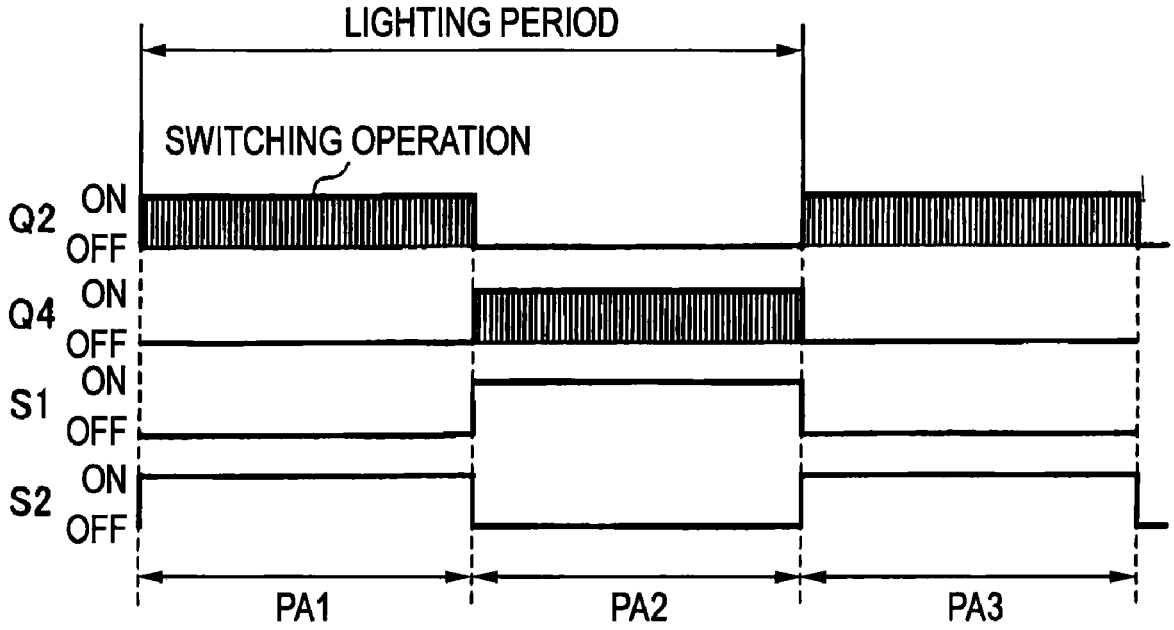
[FIG. 3] A timing chart showing a switching operation made by the discharge lamp lighting circuit according to a second embodiment of the present invention.

Operation of the foregoing configuration is explained with reference to FIG. 3.

In the above configuration, the controlling circuit 4 causes the first converter CON1 to start an operation by turning ON the switching element Q2, stops an operation of the second converter CON2 by turning OFF the switching element Q4, and turns OFF the switching element S1 and turns ON the switching element S2. Accordingly, the current IL1 flows through the discharge lamp 3 (period PA1).

When the direction of the current flowing through the discharge lamp 3 is switched to the current IL2 from this state, initially the controlling circuit 4 stops the operation of the first converter CON1 by turning OFF the switching element Q2 to create a time during which both the first converter CON1 and the second converter CON2 stop the operation. Then, the controlling circuit 4 turns OFF the switching element S2 and turns ON the switching element S1. Also, the controlling circuit 4 causes the second converter CON2 to start the step-up operation by turning ON the switching element Q4. With the above operations, the direction of the current flowing through the discharge lamp 3 is switched from the current IL1 to the current IL2 (period PA2).

Then, when the direction of the current flowing through the discharge lamp 3 is switched again from the current IL2 to the current IL1, initially the controlling circuit 4 stops the operation of the second converter CON2 by turning OFF the switching element Q4 to create a time during which both the first converter CON1 and the second converter CON2 stop the operation. Then, the controlling circuit 4 turns OFF the switching element S1, turns ON the switching element S2, and turns ON the switching element Q2, and thus causes the first converter CON1 to start the operation. With the above operations, the direction of the current flowing through the discharge lamp 3 is switched from the current IL2 to the current IL1 (period PA3).

The operations based upon such lighting periods are repeated at the lighting frequency of the discharge lamp 3. Therefore, the low-frequency AC power suitable for this discharge lamp 3 can be supplied.

As explained above, in the discharge lamp lighting circuit according to the second embodiment, the output side of the first and second converters CON1, CON2 (the secondary windings T1*b*, T2*b* side of the transformers T1, T2) are connected in parallel with the switching elements S1, S2 (referred to as "secondary side switching elements" hereinafter). First ends, from which the current is sent out, of respective converters produce the output power by virtue of the secondary side rectification in the secondary side switching elements, which gives the current flowing through the discharge lamp 3. The other ends, which are located on the side to take the current of respective converters, take the current flowing from the discharge lamp 3 when the secondary side switching elements become conductive.

Third Embodiment

Figure 4:
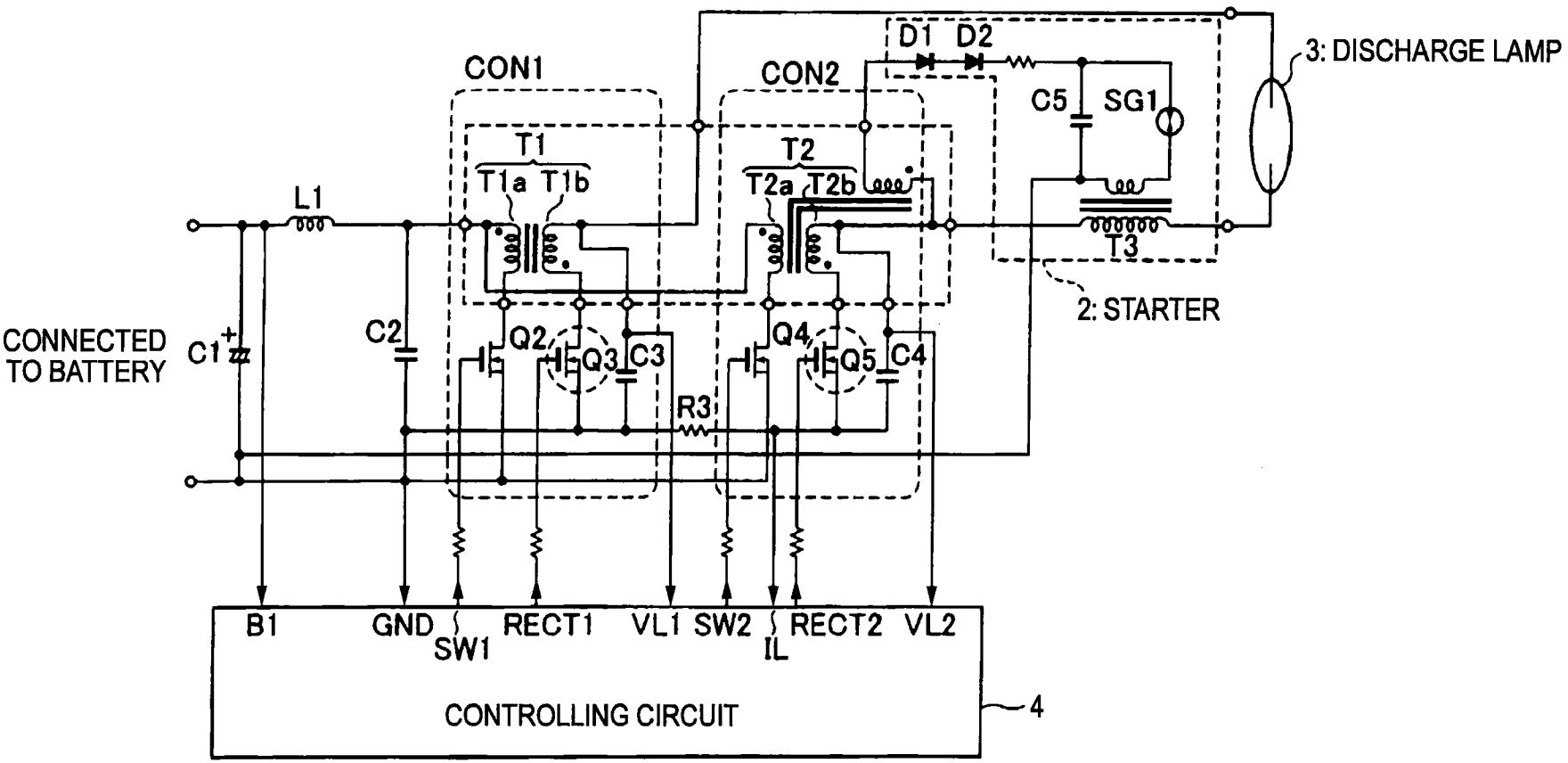
[FIG. 4] A conceptual view of a discharge lamp lighting circuit according to a third embodiment of the present invention.

A configuration of a discharge lamp lighting circuit according to a third embodiment of the present invention is shown in FIG. 4, and is explained below.

Here, the same reference symbols are used for features that are the same or substantially the same as those in FIG. 2, and detailed explanation of those features is omitted.

In the above second embodiment (FIG. 2), the switching elements S1, S2 are provided to the output ends of the first and second converters CON1, CON2. These elements are omitted in the third embodiment. Also, the rectifier diodes D3, D4 are provided to the first and second converters CON1, CON2, but such configuration is omitted herein.

In the first converter CON1, a switching element Q3 is provided to the secondary winding starting end of the transformer T1. In this example, the N-channel MOSFET is employed as the switching element Q3. A drain of the switching element Q3 is connected to the winding starting end of the secondary winding T1*b* of the transformer T1, and a source of the switching element Q3 is connected to the ground.

While the first converter CON1 is executing the step-up operation, the switching element Q3 also functions as the rectifying switching element.

The smoothing capacitor C3 is arranged to the secondary winding terminating end of the transformer T1. A terminal voltage of the smoothing capacitor C3 is picked up as the output voltage.

At this time, a control signal RECT1 is supplied from the controlling circuit 4 to a gate of the switching element Q3, and the switching of the switching element Q3 is controlled based on the control signal RECT1. Therefore, a value of the output voltage is controlled variably.

In contrast, in the second converter CON2, a switching element Q5 is provided to the secondary winding starting end of the transformer T2. In this example, the N-channel MOSFET is also employed as the switching element Q5. A drain of the switching element Q5 is connected to the winding starting end of the secondary winding T2*b* of the transformer T2, and a source of the switching element Q5 is connected to the ground.

Similarly, while the first converter CON2 is executing the step-up operation, the switching element Q5 also functions as the rectifying switching element.

The smoothing capacitor C4 is arranged to the secondary winding terminating end of the transformer T2. A terminal voltage of the smoothing capacitor C4 is picked up as the output voltage.

At this time, a control signal RECT2 is supplied from the controlling circuit 4 to a gate of the switching element Q5, and the switching of the switching element Q5 is controlled based on the control signal RECT2. Therefore, a value of the output voltage is controlled variably.

Operation of the foregoing configuration is explained in detail below with reference to FIG. 5.

While the first converter CON1 is operating, the switching element Q2 acts as the step-up switching element, the switching element Q3 acts as the rectifying switching element, and the switching element Q3 executes a synchronous rectification. Also, the second converter CON2 is brought into a non-operative state by turning OFF the switching element Q4, and the switching element Q5 is rendered conductive, and thus the current IL1 flows through the discharge lamp 3 (period PB1).

Figure 5:
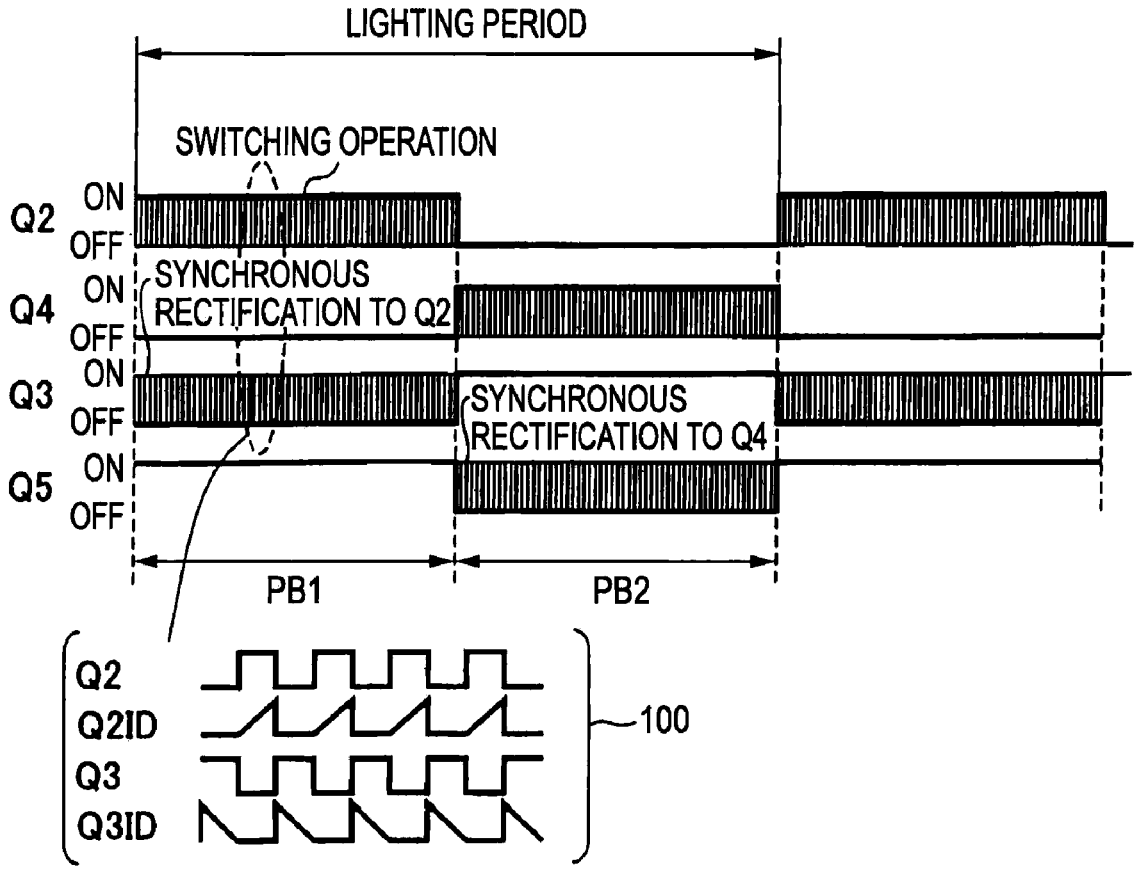
[FIG. 5] A timing chart showing a switching operation made by the discharge lamp lighting circuit according to the third embodiment of the present invention.

A behavior of the synchronous rectification is shown by numeral 100 in FIG. 5 in an enlarged fashion. Here, ON/OFF states of the switching elements Q2, Q3 and characteristics (Q2ID, Q3ID) of the currents flowing through the switching elements Q2, Q3 in response to these states are illustrated. The direction of the current flowing from the drain to the source of the switching element Q2 is set positive in a waveform Q2ID, and the direction of the current flowing from the source to the drain of the switching element Q3 is set positive in a waveform Q3ID.

Conversely, while the second converter CON2 is operating, the switching element Q4 acts as the step-up switching element, the switching element Q5 acts as the rectifying switching element, and the switching element Q5 executes a synchronous rectification. Also, the first converter CON1 is brought into a non-operative state by turning OFF the switching element Q2, and the switching element Q3 is rendered conductive, and thus the current IL2 flows through the discharge lamp 3 (period PB2).

The operations based upon such lighting periods are repeated at the lighting frequency of the discharge lamp 3. Therefore, low-frequency AC power suitable for this discharge lamp 3 can be supplied.

As explained above, in the third embodiment, the first and second converters CON1, CON2 are insulated-type switching converters. The switching elements Q3, Q5 are connected in series with the secondary windings T1*b*, T2*b* of the transformers T1, T2 of respective converters.

First ends, from which the current flows, of respective converters produce the output power by virtue of the synchronous rectification of the switching elements Q3, Q5, which gives the current flowing through the discharge lamp 3. The other ends, which are located on the side to take the current, of respective converters, take the current flowing from the discharge lamp 3 when the switching elements Q3, Q5 becomes conductive. In this manner, the switching elements Q3, Q5 can also function as the rectifying elements, and therefore the number of components can be reduced.

Fourth Embodiment

Figure 6:
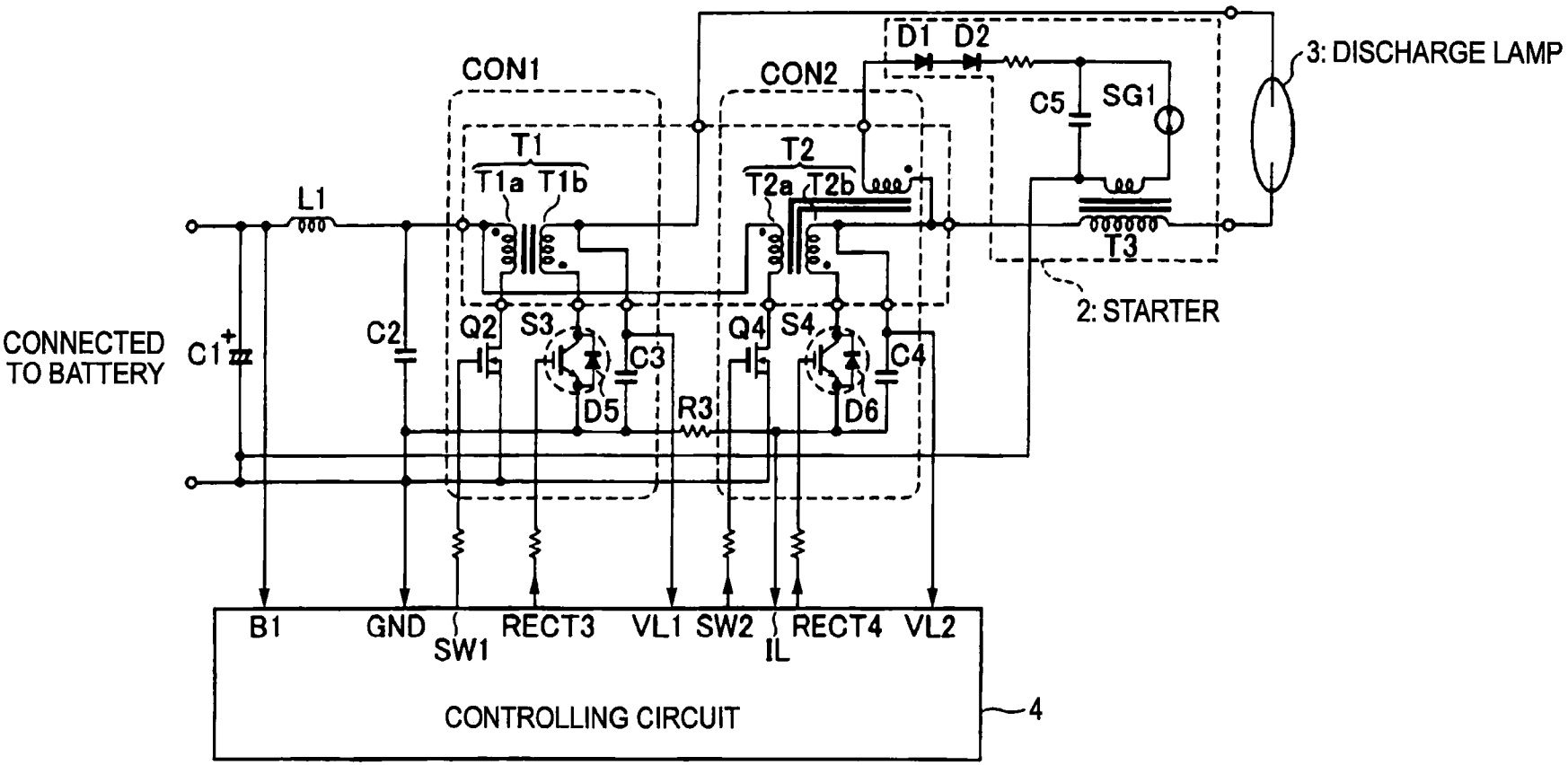
[FIG. 6] A conceptual view of a discharge lamp lighting circuit according to a fourth embodiment of the present invention.

A configuration of a discharge lamp lighting circuit according to a fourth embodiment of the present invention is shown in FIG. 6, and is explained below.

Here, the same reference symbols are used for features that are the same or substantially the same as those shown in FIG. 4. Accordingly, detailed explanation of those features is omitted.

In the third embodiment (FIG. 4), the N-channel MOSFET is provided to the secondary winding starting ends of the transformers T1, T2 of the first and second converters CON1, CON2 as the switching elements Q3, Q5 respectively, and the switching elements Q3, Q5 also function as the rectifying switching elements while respective converters are executing the step-up operation. In contrast, in the discharge lamp lighting circuit according to the fourth embodiment, the switching elements Q3, Q5 are replaced with switching elements S3, S4 constructed by the IGBT respectively, and diodes D5, D6 are added.

That is, in the first converter CON1, the switching element S3 is provided to the secondary winding starting end of the transformer T1. In this example, the IGBT is employed as the switching element S3. A collector of the switching element S3 is connected to the winding starting end of the secondary winding T1*b* of the transformer T1, and an emitter of the switching element S3 is grounded.

Then, while the first converter CON1 is executing the step-up operation, the current is rectified by the diode D5 that is connected between the emitter-collector of the switching element S3. An anode of the diode D5 is connected to an emitter of the switching element S3, and a cathode of the diode D5 is connected to a collector of the switching element S3.

The smoothing capacitor C3 is arranged to the secondary winding terminating end of the transformer T1. A terminal voltage of the smoothing capacitor C3 is picked up as the output voltage.

At this time, a control signal RECT3 is supplied from the controlling circuit 4 to a gate of the switching element S3, and the switching of the switching element S3 is controlled based on the control signal RECT3.

Similarly, in the second converter CON2, the switching element S4 is provided to the secondary winding starting end of the transformer T2. In this example, the IGBT is employed as the switching element S4. A collector of the switching element S4 is connected to the winding starting end of the secondary winding T2*b* of the transformer T2, and an emitter of the switching element S3 is grounded.

Then, while the second converter CON2 is executing the step-up operation, the current is rectified by the diode D6 that is connected between the emitter-collector of the switching element S4. An anode of the diode D6 is connected to an emitter of the switching element S4, and a cathode of the diode D6 is connected to a collector of the switching element S4.

The smoothing capacitor C4 is arranged to the secondary winding terminating end of the transformer T1. A terminal voltage of the smoothing capacitor C4 is picked up as the output voltage.

At this time, a control signal RECT4 is supplied from the controlling circuit 4 to a gate of the switching element S4, and the switching of the switching element S4 is controlled based on the control signal RECT4.

In this example, the high voltage required to produce a charging voltage to the starter circuit can be applied to the switching element S4. Therefore, when the IGBT, which has a high withstand voltage and whose ON voltage is low, is employed as this switching element S4, a power loss caused in the element can be suppressed and heat generation in the circuit can be reduced.

Figure 7:
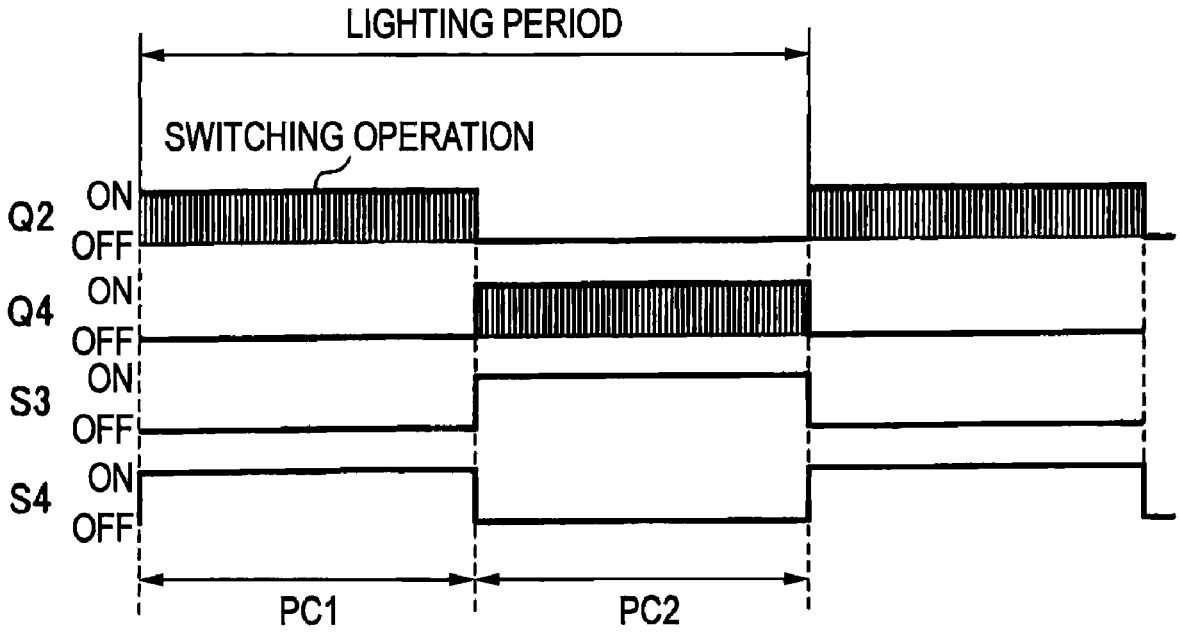
[FIG. 7] A timing chart showing a switching operation made by the discharge lamp lighting circuit according to the fourth embodiment of the present invention.

Operation of the above configuration is explained in detail below with reference to FIG. 7.

While the first converter CON1 is operating, the switching element Q2 functions as the step-up switching element and the switching element Q2 is ON/OFF-operated, and the switching element S3 is turned OFF and the current is rectified by the diode D5 that is connected between the emitter-collector of the switching element S3. In this state, the switching element S4 is brought into a conductive state and thus the current IL1 flows through the discharge lamp 3 (period PC1).

In contrast, while the second converter CON2 is operating, the switching element Q4 functions as the step-up switching element and the switching element Q4 is ON/OFF-operated, and the switching element S4 is turned OFF and the current is rectified by the diode D6 that is connected between the emitter-collector of the switching element S4. In this state, the switching element S3 is brought into a conductive state and thus the current IL2 flows through the discharge lamp 3 (period PC2).

The operations of the first and second converters CON1, CON2 are repeated at the lighting frequency of the discharge lamp 3. Therefore, the low-frequency AC power can be applied to the discharge lamp 3.

As explained above, in the discharge lamp lighting circuit according to the fourth embodiment, the switching elements S3, S4 are connected in series with the secondary windings T1*b*, T2*b* of the transformers T1, T2.

Then, at one ends of respective converters from which the current is sent out, the current is rectified by the diodes D5, D6 being connected between the emitter-collector of the switching elements S3, S4 respectively, which gives the current flowing through the discharge lamp 3. Also, the other ends, which are located on the side to take the current of respective converters, take the current flowing out from the discharge lamp 3 when the switching elements S3, S4 become conductive.

In this manner, the diodes D5, D6 connected in parallel with the switching elements S3, S4 also function as the rectifier diode respectively. Here, the number of components can be reduced by using the element in which the diodes D5, D6 and the IGBT are sealed in the same package.

Fifth Embodiment

Figure 8:
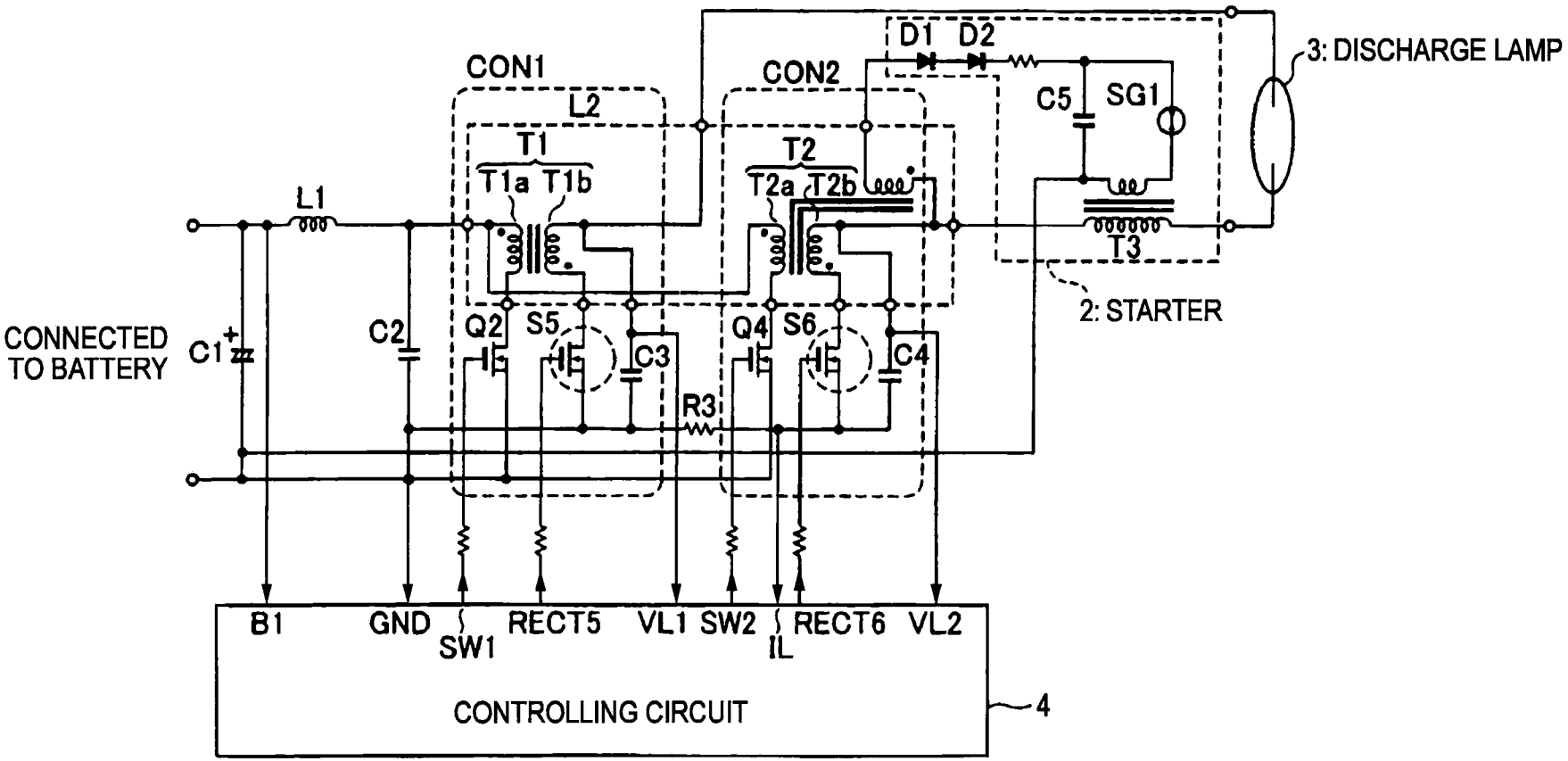
[FIG. 8] A conceptual view of a discharge lamp lighting circuit according to a fifth embodiment of the present invention.

A configuration of a discharge lamp lighting circuit according to a fifth embodiment of the present invention is shown in FIG. 8, and is explained below.

The discharge lamp lighting circuit according to the fifth embodiment has a similar configuration as that in the aforementioned third embodiment. In this case, in the aforementioned third embodiment (FIG. 4), when the first converter CON1 is executing the step-up operation, the switching element Q3 functions as the rectifying switching element, and this switching element Q3 performs the synchronous rectification. Also, when the second converter CON2 is executing the step-up operation, the switching element Q5 functions as the rectifying switching element, and this switching element Q5 performs the synchronous rectification.

In contrast, in the fifth embodiment, the rectification is executed by using passively parasitic diodes of the switching elements Q5, Q6, which is implemented by the N-channel MOSFET and correspond to the switching elements Q3, Q5 respectively.

Figure 9:
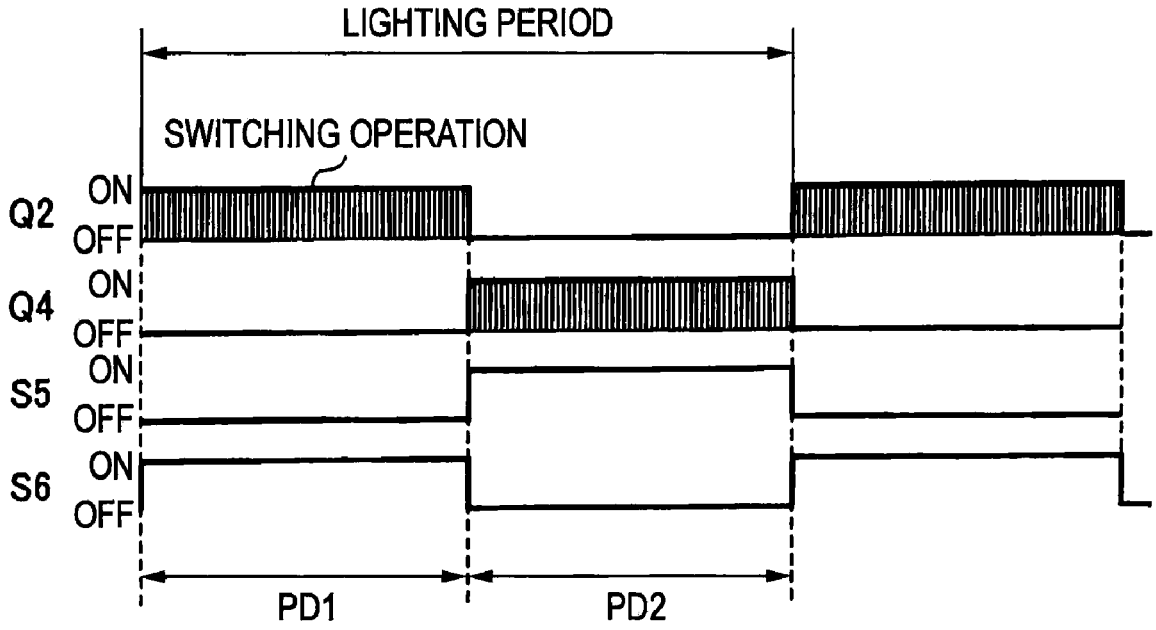
[FIG. 9] A timing chart showing a switching operation made by the discharge lamp lighting circuit according to the fifth embodiment of the present invention.

Operation of the foregoing configuration is explained in detail below with reference to FIG. 9.

While the first converter CON1 is operating, the switching element Q2 acts as the step-up switching element and the switching element Q2 is ON/OFF-operated, and the switching element S5 acts as the rectifying switching element and the current is rectified by using passively the parasitic diode of the switching element S5. In this state, a switching element S6 is brought into a conductive state and thus the current IL1 flows through the discharge lamp 3 (period PD1).

In contrast, while the second converter CON2 is operating, the switching element Q4 acts as the step-up switching element and the switching element Q4 is ON/OFF-operated, and the switching element S6 acts as the rectifying switching element and the current is rectified by using passively the parasitic diode of the switching element S6. In this state, the switching element S5 is brought into a conductive state and thus the current IL2 flows through the discharge lamp 3 (period PD2).

The operations of the first and second converters CON1, CON2 are repeated at the lighting frequency of the discharge lamp 3. Therefore, the low-frequency AC power can be applied to the discharge lamp 3.

As explained above, in the fifth embodiment, the switching elements S5, S6 are connected in series with the secondary windings T1*b*, T2*b* of the transformers T1, T2 of the first and second converters CON1, CON2. Then, at one ends of respective converters from which the current is sent out, the current is rectified by using passively the parasitic diodes of the switching elements S5, S6, which gives the current flowing through the discharge lamp 3. Also, the other ends, which are located on the side to suck the current, of respective converters suck the current being flown out from the discharge lamp 3 when the switching elements S5, S6 become conductive.

In this manner, the parasitic diodes of the switching elements S5, S6 function as the rectifier diodes. Therefore, the number of components can be reduced.

Sixth Embodiment

Figure 10:
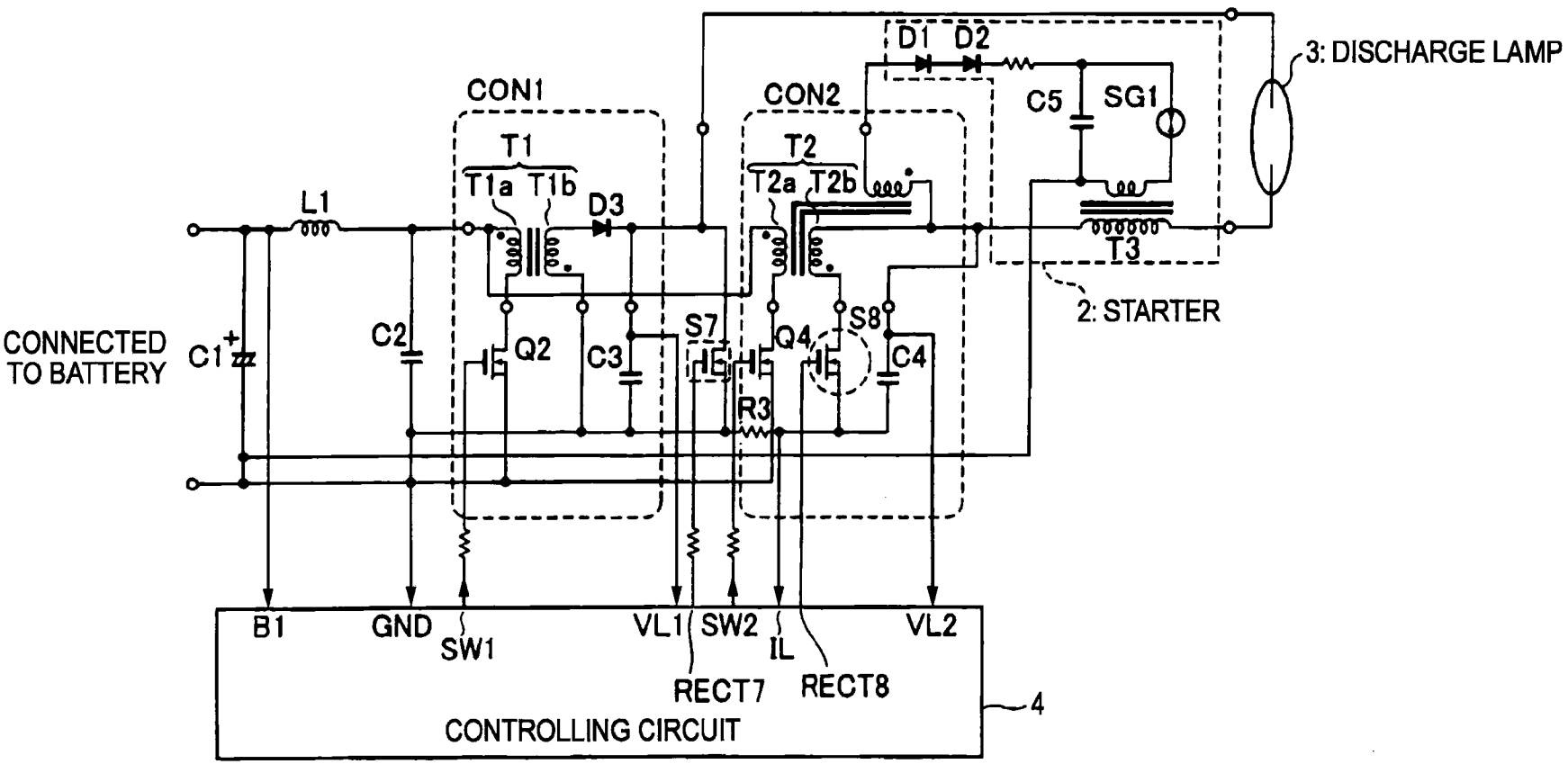
[FIG. 10] A conceptual view of a discharge lamp lighting circuit according to a sixth embodiment of the present invention.

A configuration of a discharge lamp lighting circuit according to a sixth embodiment of the present invention is shown in FIG. 10, and is explained below.

In the discharge lamp lighting circuit according to the sixth embodiment, the first converter CON1 side has the similar configuration to that in the second embodiment (FIG. 2), and the second converter CON2 has the similar configuration to that in the fifth embodiment (FIG. 8). The same reference symbols are used for features that are the same or substantially the same as those in FIG. 2 and FIG. 8. Accordingly, detailed description of those features is omitted.

As shown in FIG. 10, a switching element S7 is provided to the output end of the first converter CON1. The N-channel MOSFET (field effect transistor) is employed as the switching element S7, a control signal RECT7 is supplied from the controlling circuit 4 to a gate of the N-channel MOSFET, and the switching of the switching element S7 is controlled.

In contrast, in the second converter CON2, a switching element S8 is provided to the secondary winding starting end of the transformer T2. In this example, the N-channel MOSFET is also employed as the switching element S8. A drain of the switching element S8 is connected to the winding starting end of the secondary winding T2*b* of the transformer T2, and a source of the switching element S8 is grounded.

While the first converter CON2 is executing the step-up operation, the switching element Q8 also functions as the rectifying switching element.

The smoothing capacitor C4 is arranged to the secondary winding terminating end of the transformer T2. A terminal voltage of the smoothing capacitor C4 is picked up as the output voltage.

At this time, a control signal RECT0 is supplied from the controlling circuit 4 to a gate of the switching element Q8, and the switching of the switching element Q8 is controlled based on the control signal RECT8. Therefore, a value of the output voltage is controlled variably.

Figure 11:
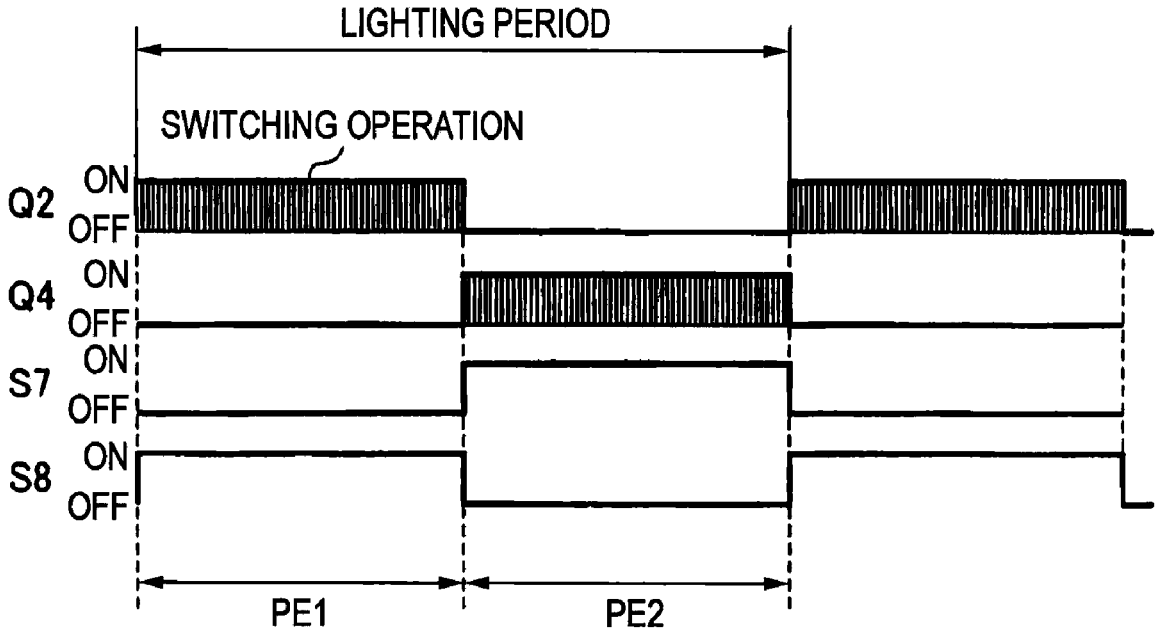
[FIG. 11] A timing chart showing a switching operation made by the discharge lamp lighting circuit according to the sixth embodiment of the present invention.

Operation of the foregoing configuration is explained below with reference to FIG. 11.

The controlling circuit 4 causes the first converter CON1 to start the operation by turning ON the switching element Q2, stops the step-up operation of the second converter CON2 by turning OFF the switching element Q4, and turns OFF the switching element S7 and turns ON the switching element S8. Accordingly, the current IL1 flows through the discharge lamp 3 (period PE1).

When the second converter CON2 is caused to operate, the switching element Q4 acts as the step-up switching element and the switching element Q4 is ON/OFF-operated, and the switching element S8 acts as the rectifying switching element and the current is rectified by using passively the parasitic diode of the switching element S8. In this state, the switching element S5 is brought into a conductive state and thus the current IL2 flows through the discharge lamp 3 (period PE2).

The operations of the first and second converters CON1, CON2 are repeated at the lighting frequency of the discharge lamp 3. Therefore, the low-frequency AC power can be applied to the discharge lamp 3.

As explained above, in the sixth embodiment, the switching element S7 is provided to the output end of the first converter CON1, and the switching element S8 is connected in series with the secondary winding T2*b* of the transformer T2 in the second converter CON2.

Then, the current is rectified by using passively the parasitic diode of the switching element S8 at one end of the second converter CON2 from which the current is sent out, which gives the current flowing through the discharge lamp 3. The other end, which is located on the side to take the current, of the second converter CON2 takes the current flowing from the discharge lamp 3 when the switching element S8 becomes conductive.

In this manner, the parasitic diode of the switching element S8 functions as the rectifier diode. Therefore, the number of components can be reduced.

Seventh Embodiment

Figure 12:
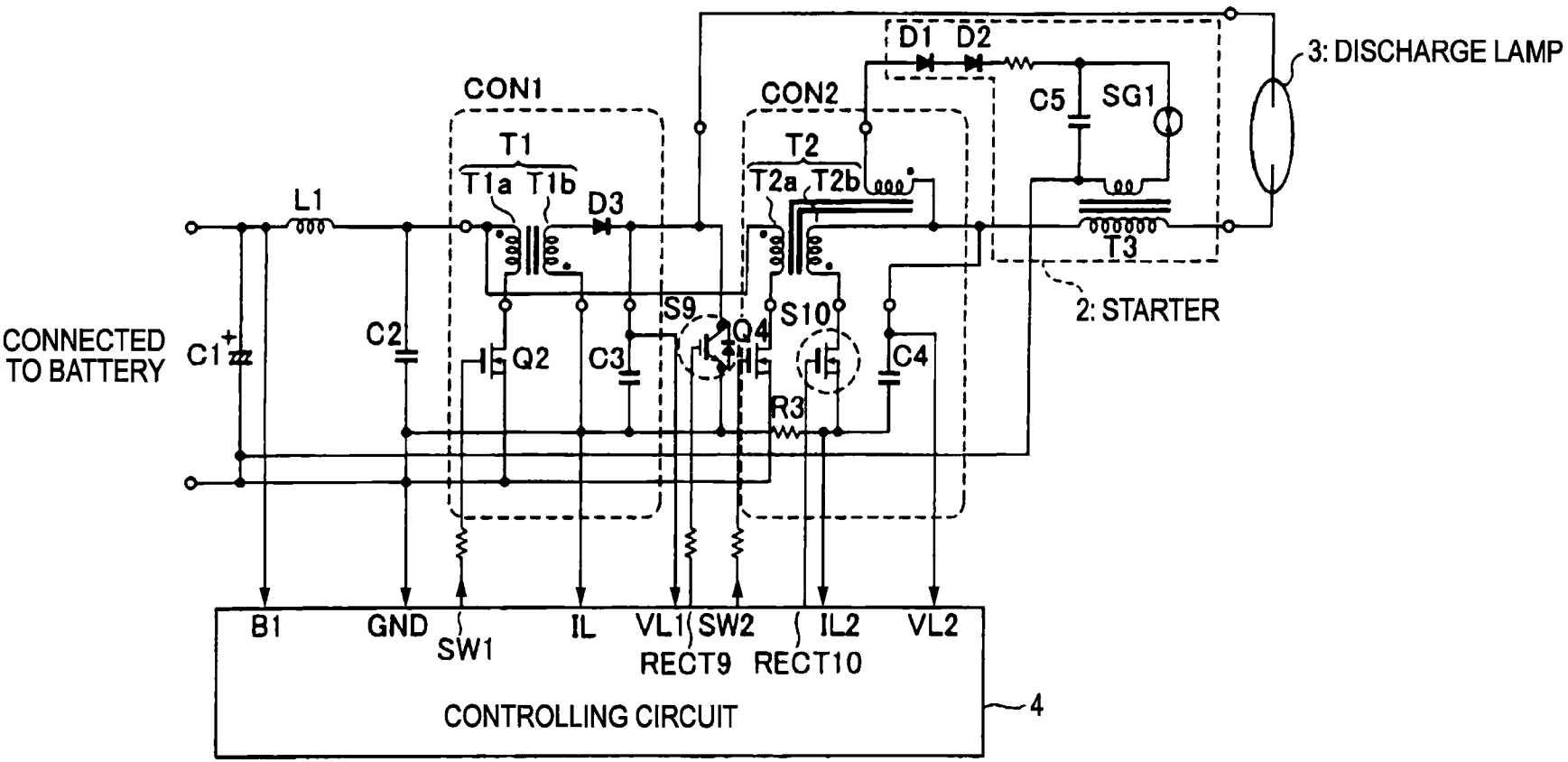
[FIG. 12] A conceptual view of a discharge lamp lighting circuit according to a seventh embodiment of the present invention.

A configuration of a discharge lamp lighting circuit according to a seventh embodiment of the present invention is shown in FIG. 12, and is explained below.

In the discharge lamp lighting circuit according to the seventh embodiment, a switching element S9 is provided to the output end of the first converter CON1. The IGBT whose ON voltage is lower is employed as the switching element S9, and a heat generation of the element can be suppressed. A control signal RECT9 is supplied from the controlling circuit 4 to a gate of the switching element S9, and the switching of the switching element S9 is controlled.

The configuration of the second converter CON2 side is similar to the configuration in the third embodiment (FIG. 4). That is, in the second converter CON2, a switching element S10 is provided to the secondary winding starting end of the transformer T2. In this example, the N-channel MOSFET is employed as the switching element S10.

A drain of the switching element S10 is connected to the winding starting end of the secondary winding T2*b* of the transformer T2. While the second converter CON2 is executing the step-up operation, the switching element S10 also functions as the rectifying switching element. The smoothing capacitor C4 is arranged to the secondary winding terminating end of the transformer T2, and a terminal voltage of the smoothing capacitor C4 is extracted as an output voltage.

At this time, a control signal RECT10 is supplied from the controlling circuit 4 to a gate of the switching element S10, and the switching of the switching element S10 is controlled based on the control signal RECT10. Therefore, a value of the output voltage is controlled variably.

Figure 13:
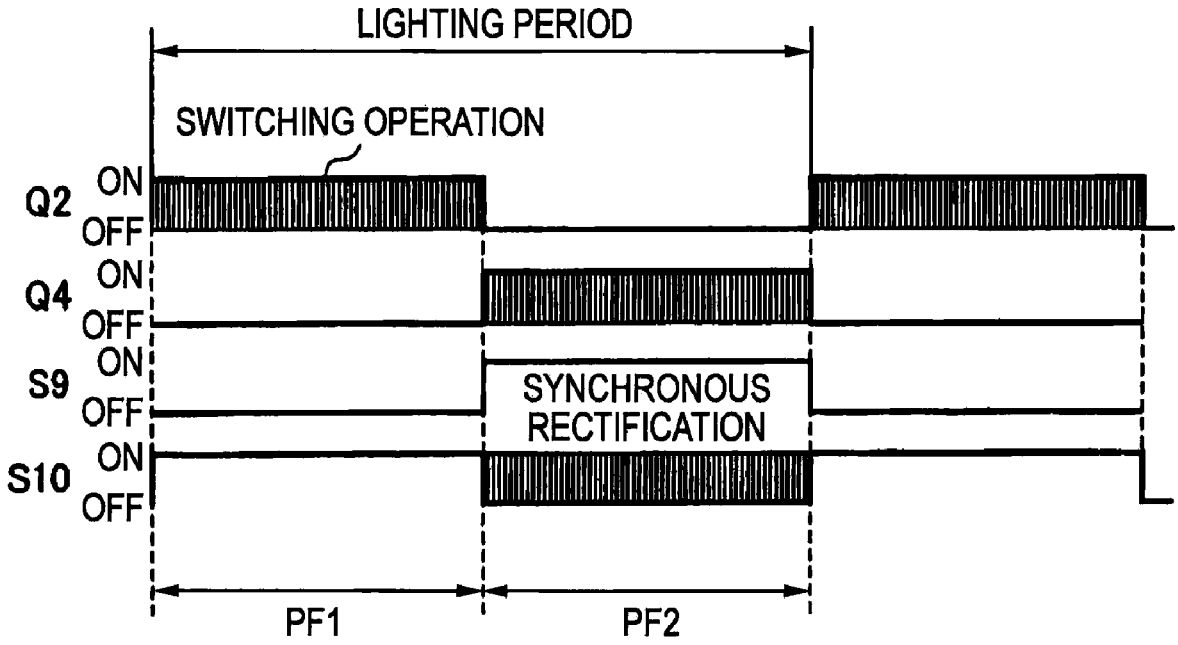
[FIG. 13] A timing chart showing a switching operation made by the discharge lamp lighting circuit according to the seventh embodiment of the present invention.

Operation of the foregoing configuration is explained in detail below with reference to FIG. 13.

The controlling circuit 4 causes the first converter CON1 to start the operation by turning ON the switching element Q2, stops the step-up operation of the second converter CON2 by turning OFF the switching element Q4. Also, the controlling circuit 4 turns OFF the switching element S9 and turns ON the switching element S10. Accordingly, the current IL1 flows through the discharge lamp 3 (period PF1).

Then, when the second converter CON2 is operated, the switching element Q4 acts as the step-up switching element, and the switching element S10 acts as the rectifying switching element, and thus the switching element S10 performs the synchronous rectification. Then, the switching element S9 is rendered conductive and thus the current IL2 flows through the discharge lamp 3 (period PF2).

The operations of the first and second converters CON1, CON2 are repeated at the lighting frequency of the discharge lamp 3. Therefore, the low-frequency AC power can be applied to the discharge lamp 3.

As explained above, in the seventh embodiment, the switching element S9 is provided to the output end of the first converter CON1, and the switching element S10 is connected in series with the secondary winding T2*b* of the transformer T2 in the second converter CON2.

Then, the switching element S10, which is connected in series with to one end of the second converter CON2 from which the current is sent out, performs the synchronous rectification, which gives the current flowing through the discharge lamp 3. The other end, which is located on the side to take the current, of the second converter CON2 takes the current flowing from the discharge lamp 3 when the switching element S10 becomes conductive. In this manner, the number of components can be reduced by the synchronous rectification of the switching element S10.

Next, arrangements of the transformers, which can be employed in respective embodiments, are explained in detail.

Figure 14:
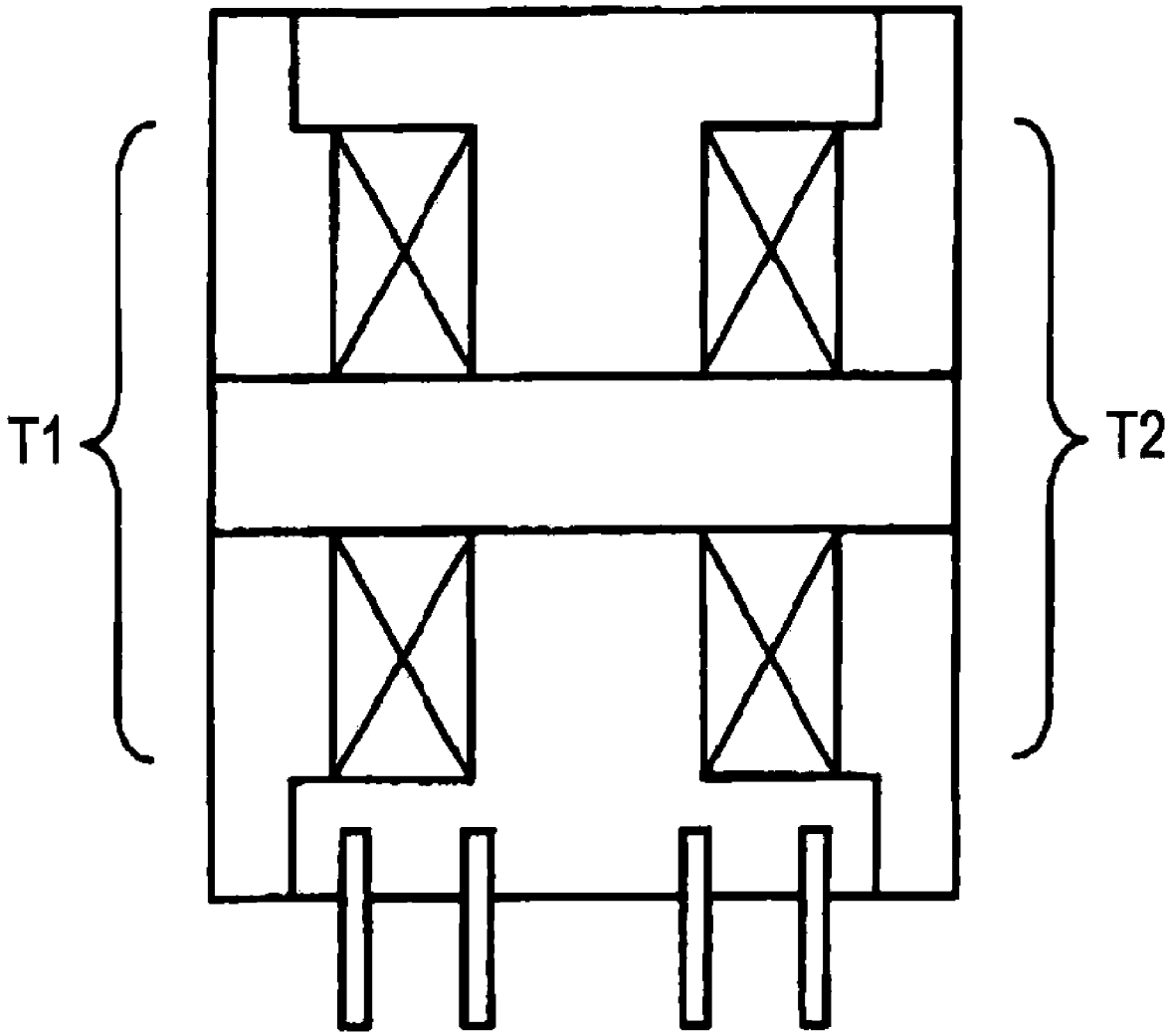
[FIG. 14] A view showing arrangements of transformers in first and second converters.

Arrangements of the transformers T1, T2 in the first and second converters CON1, CON2 are shown in FIG. 14. Normally each DC/DC converter is required of the transformer on a one-to-one basis. This transformer is one of several large-size components in the discharge lamp lighting circuit. In this case, in the first to seventh embodiments, the magnetic substances that are employed separately in known transformers T1, T2 are used commonly as one transformer, and thus a reduction in the number of components, a size reduction, and a cost reduction can be implemented further.

That is, the step-up transformers T1, T2 in two systems of converter constitute two systems of switching converter transformer in which magnetic paths of the magnetic fluxes are provided by one closed magnetic member and two systems of strong magnetic coupling are formed. Also, two systems of magnetic coupling are given by the magnetically loose coupling, and the magnetically interference between two systems is very small.

According to the embodiments of the present invention, the discharge lamp lighting circuit in which commonality of the electronic components is achieved by combining the DC/DC converting function in a known DC/DC converter with the DC/AC converting function in the full-bridge inverter to attain a size reduction and a cost reduction can be provided. Also, the first and second converters can be operated alternately, whereby the amount of generated heat is reduced and the locations where the heat is generated are separated, the temperature is raised locally, and reliability can be improved.

That is, the first and second converters CON1, CON2 are implemented by any one of (a) a converter having an insulated-type first transformer (e.g., T1), a first switching element (e.g., Q2, Q4) connected in series between a DC power supply and a primary winding of the first transformer, and a second switching element (e.g., Q3, Q5, S10) connected in series between an output end and a secondary winding of the first transformer, whereby the first and second switching elements are driven in synchronism with each other in each half period of a first frequency at a second frequency higher than the first frequency, (b) a converter having an insulated-type second transformer (e.g., T2), a third switching element (e.g., Q2, Q4) connected in series between a DC power supply and a primary winding of the second transformer, a first rectifying element connected in series between one output end and a secondary winding of the second transformer, and a fourth switching element (e.g., S1, S2, S7, S9) connected between one output end and the other output end, whereby the fourth switching element is put in an OFF state while the third switching element executes a driving operation and also the fourth switching element is put in an ON state while the third switching element executes a stopping operation, or (c) a converter having an insulated-type third transformer (e.g., T1), a fifth switching element (e.g., Q2, Q4) connected in series between a DC power supply and a primary winding of the third transformer, a sixth switching element (e.g., S3 to S6, S8) connected in series between an output end and a secondary winding of the third transformer, and a second rectifying element connected in parallel with the sixth switching element, whereby the sixth switching element is put in an OFF state while the fifth switching element executes a driving operation and also the sixth switching element is put in an ON state while the fifth switching element executes a stopping operation.

In this case, the first and second converters CON1, CON2 have a capacitive element at on output end on the secondary side respectively, and operate only one converter before the discharge lamp is started, to charge the capacitive element on the secondary side at a voltage of several hundred V. The first and second converters CON1, CON2 flow the charges stored in the capacitive element to the discharge lamp (takeover current) immediately after the discharge lamp is started, to promote the discharge growth from the glow discharge to the arc discharge. Here, the switching element on the secondary side of the other converter is operated in the active range (i.e., exhibits behavior as a suction type current source), and thus the takeover current can be controlled.

In all embodiments, the lighting frequency of the discharge lamp (first frequency) preferably should be set to 250 Hz to 750 Hz, for example, as a headlamp of a car.

Also, it is desirable that a driving frequency of the primary switching element (Q2, Q4) (second frequency) be set higher than the first frequency by 10 times or more, and preferably 100 times or more. For example, 50 kHz to 2 MHz is desirable.

The discharge lamp lighting circuit can have a configuration such that two converters are arranged on both sides of the discharge lamp 3, respectively (called as a "double converter type" hereinafter). In such a circuit mode of the double converter type discharge lamp lighting circuit, the peculiar problem explained below can arise.

In the discharge lamp lighting circuit of double converter type, a first state, in which a high voltage is applied from one converter CON1 to one end side of the discharge lamp 3 and the other end side is kept at a ground potential, and a second state, in which a high voltage is applied from the other converter CON2 to the other end side of the discharge lamp 3 and one end side is kept at a ground potential, are repeated alternately every lighting period (called an "inverter operation" hereinafter).

The charges accumulated in the smoothing capacitors C3, C4 provided to the output ends of the first and second converters CON1, CON2 should essentially flow in the discharge lamp 3; nevertheless such charges have nowhere to go when the inverter operation is continued in a situation that the load of the discharge lamp lighting circuit of double converter type is opened, for example, as the result of the failure of the discharge lamp as the driven subject, the bad contact of the connector. Therefore, the smoothing capacitors C3, C4 continue to discharge such charges abruptly via the switching elements that are provided in series with these smoothing capacitors. Concretely, the smoothing capacitor C3 shown in FIG. 2 discharges the charges via the switching element S1, and the smoothing capacitor C4 discharges the charges via the switching element S2. Also, the smoothing capacitor C3 shown in FIG. 4 discharges the charges via the switching element Q3, and the smoothing capacitor C4 discharges the charges via the switching element Q5. Also, the smoothing capacitor C3 shown in FIG. 6 discharges the charges via the switching element S3, and the smoothing capacitor C4 discharges the charges via the switching element S4. Also, the smoothing capacitor C3 shown in FIG. 8 discharges the charges via the switching element S5, and the smoothing capacitor C4 discharges the charges via the switching element S6.

When the overcurrent flows through the switching element on account of the abrupt discharge, there is a danger that reliability of the switching element decreases. This problem can be solved preferably by several of the aforementioned embodiments and other embodiments.

In order to solve this problem, it is desirable that the current limiting circuit element be provided to the location that is positioned in series of the switching element through which the overcurrent may flow. As this circuit element, the impedance element, preferably the resistor element, is suitable. In the assumption that the resistor is provided, this circuit element is called a "protection resistor."

When the protection resistor is provided, the smoothing capacitor and the protection resistor constitute a CR circuit. Therefore, the load of the discharge lamp lighting circuit becomes open, a rate of discharge conducted via the switching element is limited by a CR time constant, and thus the discharge current can be suppressed. In turn, reliability of the switching element can be enhanced.

Preferably, the protection resistor should be provided on the common terminal (i.e., the emitter or the source) sides of the switching elements S1 to S6. In this case, when a large current flows through the protection resistor, a voltage drop in the protection resistor is increased. Thus, a potential of the common terminals of the switching elements S1 to S6 rises, and the gate-emitter voltages (the gate-source voltages, the base-emitter voltages) of the switching elements S1 to S6 is decreased. As a result, a negative feedback is applied in the direction along which an extent of ON level of the switching elements S1 to S6 is weakened, and thus the switching elements S1 to S6 can be protected preferably.

Figure 15:
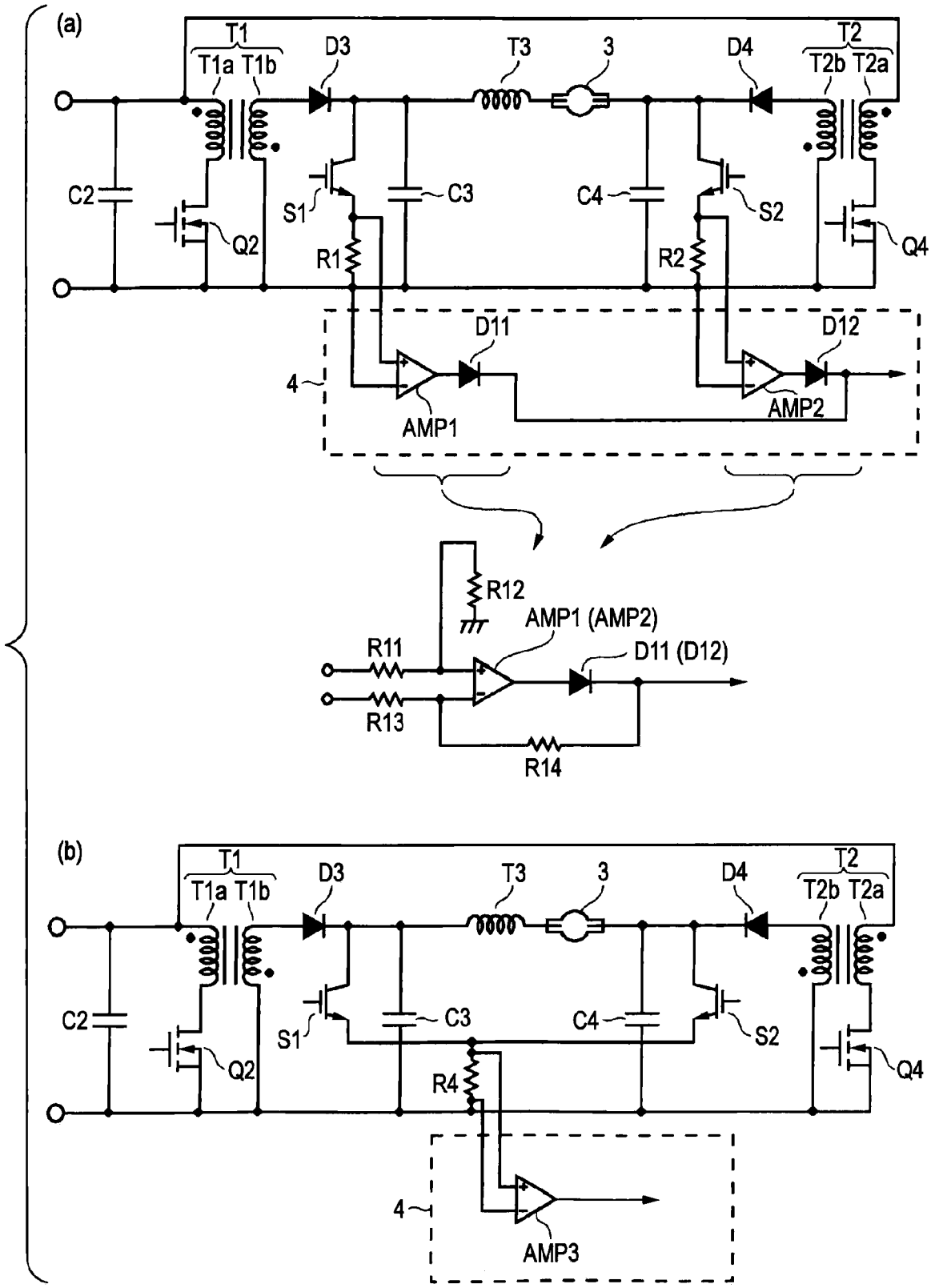
[FIG. 15] FIGS. 15(*a*) (*b*) are a configurative view showing the discharge lamp lighting circuit according to the embodiments respectively.

The discharge lamp lighting circuit in FIG. 2 shows an example in which the protection resistors are provided. Therefore, the discharge lamp lighting circuit in FIG. 2 will be explained, with the resistors R1, R2 acting as the protection resistors. FIGS. 15(*a*) (*b*) are circuit diagrams showing a configuration of a discharge lamp lighting circuit having protection resistors according to the embodiment respectively. The discharge lamp lighting circuit in FIG. 15(*a*) is equivalent to the discharge lamp lighting circuit in FIG. 2. Thus, the same reference symbols are used for the corresponding members, and detailed explanation is omitted.

In FIG. 15(*a*) (and FIG. 2), the resistor R1 is provided in series with the switching element S1 that is provided on the discharge path of the smoothing capacitor C3. Similarly, the resistor R2 is provided in series with the switching element S2 that is provided on the discharge path of the smoothing capacitor C4. As described above, these resistors R1, R2 are the elements that are provided essentially to detect a lamp current IL in the normal operation of the discharge lamp 3, but these resistors R1, R2 act as the protection resistors at a time of open failure of the discharge lamp 3 to suppress the discharge current. Therefore, according to the configuration shown in FIG. 2, even when the open failure is caused in the discharge lamp 3, it can be suppressed that the overcurrent flows through the switching elements S1, S2, and reliability of respective circuit elements, in turn the overall discharge lamp lighting circuit, can be enhanced.

In the discharge lamp lighting circuit in FIG. 15(*a*), two differential amplifiers AMP1, AMP2 are provided to the controlling circuit 4. The differential amplifiers AMP1, AMP2 amplify the voltage drop in two current detecting resistors R1, R2. Diodes D11, D12 constitute a diode OR circuit (maximum value circuit) whose cathodes are connected in common, and output a higher output out of output voltages of the differential amplifiers AMP1, AMP2. The later circuit (not shown) receives the signals from the cathodes of the diodes D11, D12, being connected commonly, as the signal corresponding to the lamp current IL, and controls a duty ratio of the switching elements Q2, Q4 by virtue of the pulse modulation. In this case, the configuration of the controlling circuit 4 can be set arbitrarily, and various type circuits can be utilized.

In this case, the configuration of the controlling circuit 4 in FIG. 15(*a*) corresponds to the case where the diodes D11, D12 are assumed as an ideal rectifying element (diode whose forward voltage Vf=0 V) respectively. However, the forward voltage of the actual rectifying element has some non-zero value (e.g., 0.7 V). Therefore, in order to eliminate the influence of the voltage drop of the forward voltage Vf, it is preferable that a pair of the differential amplifier AMP1 and the diode D11 and a pair of the differential amplifier AMP2 and the diode D12, for example, should have a circuit mode shown at the lower stage in FIG. 15(*a*) respectively.

In the circuit configuration at the lower stage, a voltage of the cathode of the diode D11 (D12) is fed back to the inverting input terminal of the differential amplifier AMP1 (AMP2) via a pair of resistors R13 and R14. Also, the voltage drop in the current detecting resistor R1 (R2) is divided by resistors R11, R12, and is input into the non-inverting input terminal of the differential amplifier AMP1 (AMP2). According to this configuration, the influence of the forward voltage Vf of the diode D11 (D12) (i.e., level shift of the voltage) can be substantially eliminated, and thus the signal processing with high linearity with respect to the voltage drop in the resistor R1 (R2), i.e., the lamp current can be applied.

Figure 16:
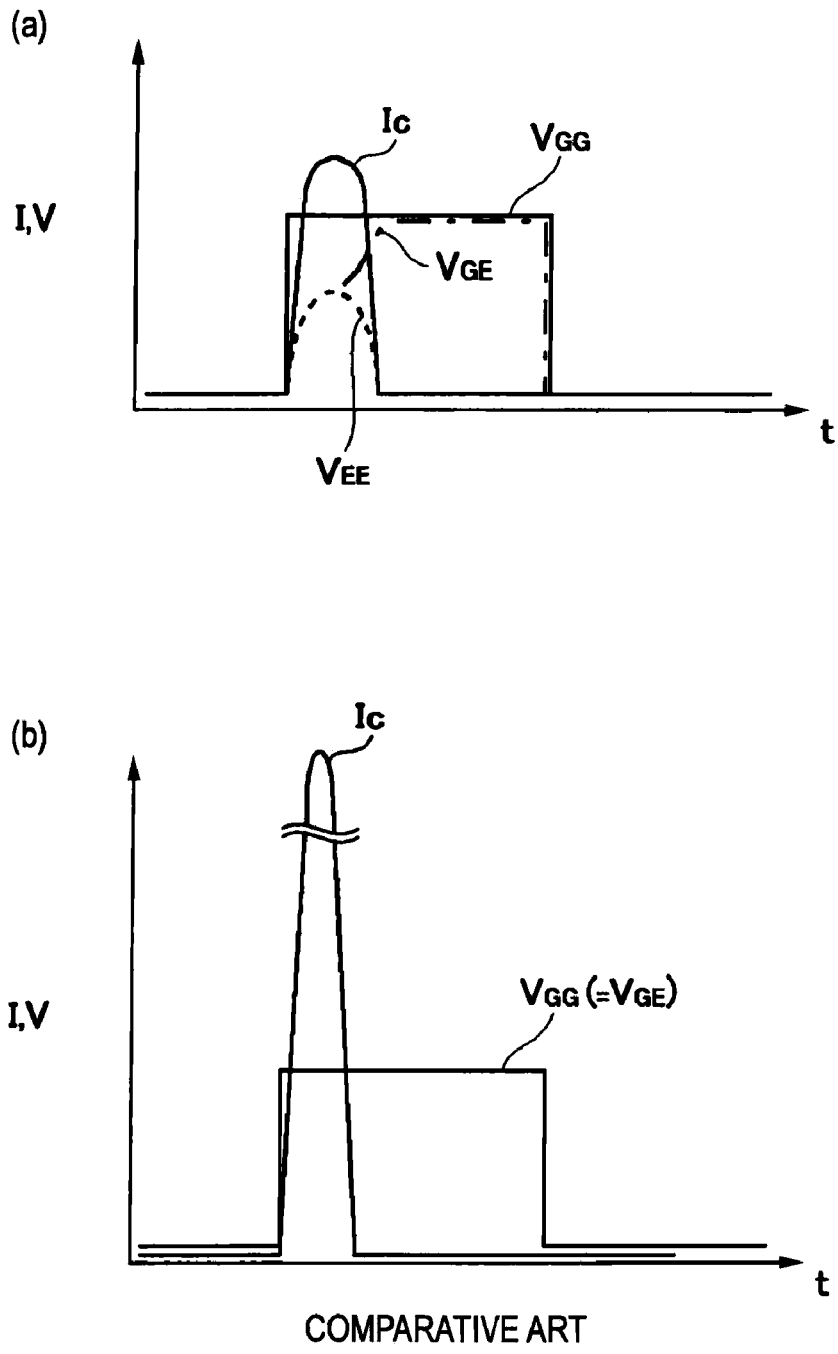
[FIG. 16] FIGS. 16(*a*) (*b*) are an operation waveform diagram of the discharge lamp lighting circuit in FIG. 15(*a*) and an operation waveform diagram of the comparative art in an open state respectively.

FIG. 16 (*a*) is an operation waveform diagram in a state that the load of the discharge lamp lighting circuit in FIG. 15(*a*) is opened. This waveform diagram focuses on the first converter CON1 side. Ic denotes a discharge current flowing through the switching element S1, $V_{GE}$ denotes a gate-emitter potential of the switching element S1, $V_{EE}$ denotes an emitter potential of the switching element S1, and $V_{GG}$ denotes a gate potential of the switching element S1.

When the switching element S1 is turned ON in a state that the load is open, the charges accumulated in the smoothing capacitor C3 cannot flow in the discharge lamp 3, and flow in the ground terminal GND via the switching element S1. When the switching element S1 is turned ON, the discharge current Ic starts to increase sharply and accordingly the voltage drop of the resistor R1, i.e., the emitter potential $V_{EE}$ is increased. The relationship $$V_{GE}=V_{GG}-V_{EE}$$

is satisfied between the emitter potential $V_{EE}$, the gate potential $V_{GG}$, and the gate-emitter potential $V_{GE}$. Therefore, according to an increase of the emitter potential $V_{EE}$, the gate-emitter potential $V_{GE}$ of the switching element S1 becomes small, an ON level of the switching element S1 becomes low, and a resistance component R0*n*1 of the switching element S1 is increased. Since a CR time constant that specifies a waveform of the discharge current Ic is defined by a synthetic resistance of the resistance component R0*n*1 of the switching element S1 and the resistor R1, a peak of the discharge current Ic can be suppressed further by increasing the resistance component R0*n*1. Also, the discharge current flowing through the switching element S2 can be suppressed by the resistor R2, on the other end (the second converter CON2) side of the discharge lamp 3.

In this manner, according to the discharge lamp lighting circuit in FIG. 15(*a*) and FIG. 2, the large current flowing through the switching elements S1, S2 can be suppressed in a load open state, and reliability of the circuit can be enhanced.

The advantages achieved by the discharge lamp lighting circuit in FIG. 15(*a*) and FIG. 2 can be made clearer in contrast to the discharge lamp lighting circuit in which the protection resistors are not provided. FIG. 16(*b*) is an operation waveform diagram in a state that the load of the circuit, in which the protection resistors R1, R2 are removed from the circuit in FIG. 15(*a*) according to the comparative art, is opened.

When the switching element S1 repeats ON/OFF intermittently in a lighting period in a state that the load is open, the charges stored in the smoothing capacitor C3 cannot flow in the discharge lamp 3. Thus, such charges flow in the ground terminal GND via the switching element S1. For the purpose of reducing a power loss as small as possible in a state that the discharge lamp 3 is normally turned ON, the gate potential $V_{GG}$ applied to the switching element S1 is set such that the switching element S1 should be turned ON in a full-ON state or a similar state. As a result, the smoothing capacitor C3 is grounded via the switching element S1, and thus the large current Ic flows through the switching element S1. This is the problem peculiar to the double converter type the discharge lamp lighting circuit.

Referring to FIG. 16(*a*) to see the discharge current Ic, it is apparent that a peak is suppressed in contrast to a waveform in FIG. 16(*b*). That is, according to the discharge lamp lighting circuit in FIG. 15(*a*) an FIG. 2, such a problem peculiar to the double converter type can be solved that the large current flows through the switching elements S1, S2 upon opening the load.

FIG. 15(*b*) is a circuit diagram showing a variation of the discharge lamp lighting circuit in FIG. 15(*a*). In FIG. 15(*b*), the configuration that the protection resistors R1, R2 in FIG. 15(*a*) are shared with two switching elements S1, S2 is shown. In FIG. 15(*b*), the constituent elements that are common to FIG. 15(*a*) are omitted appropriately.

More concretely, one end of the switching element S1 is connected to the output terminal of the first converter CON1, and one end of the switching element S2 is connected to the output terminal of the second converter CON2. The other ends of the switching elements S1, S2 are connected in common.

A current detecting resistor R4 also acting as the protection resistor is provided between the other ends of the switching elements S1, S2 connected in common and the fixed voltage terminal (ground terminal). A voltage drop of the current detecting resistor R4 is input into the controlling circuit 4 as a signal corresponding to the lamp current IL.

While the controlling circuit 4 causes the first converter CON1 to drive/operate, it adjusts an ON/OFF duty ratio of the switching element Q2 on the first converter CON1 side, based on at least the voltage drop produced in the current detecting resistor R4. Similarly, while the controlling circuit 4 causes the second converter CON2 to drive/operate, it adjusts an ON/OFF duty ratio of the switching element Q4 on the second converter CON2 side, based on at least the voltage drop produced in the current detecting resistor R4.

The controlling circuit 4 has a differential amplifier AMP3 that amplifies the voltage drop in the current detecting resistor R4. A circuit (not shown) at the later stage receives an output of the differential amplifier AMP3 as a signal responding to the lamp current IL, and controls duty ratios of the switching elements Q2, Q4 in terms of the pulse modulation.

According to the discharge lamp lighting circuit in FIG. 15(*b*), the lamp current IL that flows through the discharge lamp 3 in the first direction or the second direction as the opposite direction to the first direction can be detected by the single current detecting resistor R4. As in the circuit in FIG. 15(*a*), the discharge lamp lighting circuit in FIG. 15(*b*) can suppress preferably the current flowing through the switching elements S1, S2 in the load open state.

In the circuit in FIG. 15(*b*), the number of current detecting resistors (protection resistors) can be reduced by one rather than the circuit in FIG. 15(*a*). This is advantageous from the viewpoint of circuit area and a cost. Also, the matching between two the current detecting resistors R1, R2 with high precision is needed in the circuit in FIG. 15(*a*), but is not needed in the circuit in FIG. 15(*b*).

To receive two detection signals in response to two directions of the lamp current IL, pads (terminals) in two systems must be provided to the controlling circuit 4. On the other hand, the lamp signals detected in two directions can be integrated into one system in FIG. 15(*b*), and therefore the number of pads (terminals) provided to the controlling circuit 4 can be reduced. Also, the internal configuration of the controlling circuit 4 in FIG. 15(*b*) can be simplified rather than the configuration in FIG. 15(*a*).

In the discharge lamp lighting circuit in FIGS. 15(*a*), (*b*), the case where the current detecting resistors R1, R2, R4 for detecting the lamp current IL also function as the protection resistor in the open load state is explained. But the present invention is not limited to this case. That is, another protection resistor may be provided on the path, which is provided in series with the switching element to be protected, separately from the current detecting resistor. In this case, in order to attain the current suppressing effect by the aforementioned negative feedback, it is desirable that the protection resistor should be arranged on the emitter (source) side of the switching element.

For example, in FIG. 4, the protection resistor may be provided between the source of the switching element Q3 and the ground terminal GND. In FIG. 6, the protection resistor may be provided between the emitter of the switching element Q3 and the ground terminal GND. In FIG. 8 and FIG. 10, the protection resistor may be provided between the sources of the switching elements S5, S7 and the ground terminal GND respectively. In FIG. 12, the protection resistor may be provided between the emitter of the switching element Q4 and the ground terminal GND. It is obvious for those skilled in the art that various variations may be provided in addition to these illustrations.

In respective embodiments, the case where the positive voltage is produced by two converters CON1, CON2, and is applied to the discharge lamp 3 (referred to as a "positive polarity lighting" herein) is explained. But the negative voltage may be produced to drive the discharge lamp 3 (referred to as a "negative polarity lighting" herein). In this case, the direction of the rectifier diodes D3, D4, the polarity of the secondary windings of the first and second transformers, the direction of the switching elements connected to the secondary winding side of respective transformers, and the direction of the rectifying elements connected in parallel with the switching elements may be reversed in Figures respectively.

Various modifications are within the scope of the following claims.

What is claimed is:

1. A discharge lamp lighting circuit for supplying an AC power to a discharge lamp, the discharge lamp comprising:

first and second converters for receiving a DC voltage and stepping up the voltage; and a controlling circuit for driving the first and second converters alternately at a first frequency and stopping an operation of the converter that is not driven such that the AC power is supplied to the discharge lamp to execute a lighting operation, wherein the first and second converters are implemented by any of (a) a converter having an insulated-type first transformer, a first switching element connected in series between a DC power supply and a primary winding of the first transformer, and a second switching element connected in series between an output end and a secondary winding of the first transformer, wherein the first and second switching elements are arranged to be driven in synchronism with each other in each half period of the first frequency at a second frequency higher than the first frequency, (b) a converter having an insulated-type second transformer, a third switching element connected in series between the DC power supply and a primary winding of the second transformer, a first rectifying element connected in series between one output end and a secondary winding of the second transformer, and a fourth switching element connected between one output end and the other output end, wherein the converter is arranged so that the fourth switching element is put in an OFF state while the third switching element executes a driving operation, and the fourth switching element is put in an ON state while the third switching element executes a stopping operation, or (c) a converter having an insulated-type third transformer, a fifth switching element connected in series between a DC power supply and a primary winding of the third transformer, a sixth switching element connected in series between an output end and a secondary winding of the third transformer, and a second rectifying element connected in parallel with the sixth switching element, wherein the converter is arranged such that the sixth switching element is put in an OFF state while the fifth switching element executes a driving operation, and the sixth switching element is put in an ON state while the fifth switching element executes a stopping operation.

2. A discharge lamp lighting circuit according to claim 1, wherein the insulated-type first to third transformers in the first and second converters are arranged such that a part of magnetic members is shared mutually.

3. A discharge lamp lighting circuit according to claim 1, wherein at least one of second, fourth, and sixth switching elements on secondary sides of the first and second converters is implemented by an insulated gate bipolar transistor.

4. A discharge lamp lighting circuit according to claim 3, further comprising:

a starter circuit for starting the discharge lamp, and having a starter capacitor to receive a charging voltage from one of the first and second converters;

wherein the converter on a side from which the charging voltage is supplied to the starter circuit is implemented by the converter set forth in (b) or (c), and the fourth or sixth switching element on the secondary side is implemented by the insulated gate bipolar transistor.

5. A discharge lamp lighting circuit for supplying an AC power to a discharge lamp, the discharge lamp comprising:

first and second converters for receiving a DC voltage and stepping up the voltage; and a controlling circuit for driving the first and second converters alternately at a first frequency and stopping an operation of the converter that is not driven such that the AC power is supplied to the discharge lamp to execute a lighting operation, wherein each of the first and second converters includes:

an insulated transformer, a first switching element connected in series with a primary winding of the transformer, a first rectifying element provided between an output end and a secondary winding of the transformer, and a second switching element and a current detecting resistor connected in series between the output end and a fixed voltage terminal, wherein the controlling circuit is arranged to put the second switching element in an OFF state while the first switching element is caused to drive/operate, and to put the second switching element in an ON state while the first switching element is caused to stop an operation, and the controlling circuit is arranged to adjust an ON/OFF duty ratio of the first switching element on the first converter side based at least in part on a voltage drop produced in the current detecting resistor on the second converter side while the first converter is caused to drive/operate, and to adjust an ON/OFF duty ratio of the first switching element on the second converter side based at least in part on a voltage drop produced in the current detecting resistor on the first converter side while the second converter is caused to drive/operate.

6. A discharge lamp lighting circuit for supplying an AC power to a discharge lamp, the discharge lamp comprising:

first and second converters for receiving a DC voltage and stepping up the voltage; and a controlling circuit for driving the first and second converters alternately at a first frequency and stopping an operation of the converter that is not driven such that the AC power is supplied to the discharge lamp to execute a lighting operation, wherein each of the first and second converters includes:

an insulated transformer, a first switching element connected in series with a primary winding of the transformer, a first rectifying element provided between an output end and a secondary winding of the transformer, and a second switching element whose one end is connected to the output end, and wherein another end of the second switching element on the first converter side and another end of the second switching element provided on the second converter side are connected in common, the discharge lamp lighting circuit further comprising:

a current detecting resistor provided between the other end of the second switching element connected in common and a fixed voltage terminal;

wherein the controlling circuit is arranged to put the second switching element in an OFF state while the first switching element is caused to drive/operate, and to put the second switching element in an ON state while the first switching element is caused to stop an operation, and the controlling circuit is arranged to adjust an ON/OFF duty ratio of the first switching element on the first converter side based at least in part on a voltage drop produced in the current detecting resistor on the second converter side while the first converter is caused to drive/operate, and to adjust an ON/OFF duty ratio of the first switching element on the second converter side based at least in part on a voltage drop produced in the current detecting resistor on the first converter side while the second converter is caused to drive/operate.

7. A discharge lamp lighting circuit according to claim 6, wherein the respective insulated transformers in the first and second converters are arranged such that a part of magnetic members is shared mutually.

8. A discharge lamp lighting circuit according to claim 6, wherein the second switching element on secondary sides of the first and second converters is implemented by an insulated gate bipolar transistor.

9. A discharge lamp lighting circuit according to claim 8, further comprising:

a starter circuit for starting the discharge lamp, and having a starter capacitor to receive a charging voltage from one of the first and second converters;

wherein the second switching element on the secondary side is implemented by the insulated gate bipolar transistor.

10. A discharge lamp lighting circuit according to claim 6 wherein an output of the first converter and an output of the second converter have the same polarity with respect to the fixed voltage terminal.

* * * * *